US011264186B2

(12) United States Patent
Chao

(10) Patent No.: US 11,264,186 B2
(45) Date of Patent: Mar. 1, 2022

(54) KEYSWITCH STRUCTURE

(71) Applicant: Darfon Electronics Corp., Taoyuan (TW)

(72) Inventor: Ling-Hsi Chao, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/037,988

(22) Filed: Sep. 30, 2020

(65) Prior Publication Data

US 2021/0012983 A1 Jan. 14, 2021

Related U.S. Application Data

(63) Continuation-in-part of application No. 16/823,318, filed on Mar. 18, 2020, now Pat. No. 10,867,759.

(30) Foreign Application Priority Data

Apr. 11, 2019 (TW) ..... 108112668
Jul. 9, 2019 (TW) ..... 108124078
Jul. 9, 2019 (TW) ..... 108124092

(51) Int. Cl.
*H01H 3/12* (2006.01)
*H01H 13/7065* (2006.01)

(52) U.S. Cl.
CPC ..... *H01H 13/7065* (2013.01); *H01H 3/125* (2013.01); *H01H 2221/058* (2013.01)

(58) Field of Classification Search
CPC ..... H01H 3/125; H01H 13/705; H01H 13/14; H01H 13/70; H01H 13/704;
(Continued)

(56) References Cited

U.S. PATENT DOCUMENTS 6,455,794 B2 9/2002 Sato et al.
6,586,695 B2 * 7/2003 Sato ..... H01H 3/122 200/344
(Continued)

FOREIGN PATENT DOCUMENTS

CN 101625936 A 1/2010
CN 101661846 A 3/2010
(Continued)

OTHER PUBLICATIONS

CN Office Action dated Dec. 2, 2020 in Chinese application (No. 201910747578.6).
(Continued)

*Primary Examiner* — Ahmed M Saeed
(74) *Attorney, Agent, or Firm* — McClure, Qualey & Rodack, LLP

(57) ABSTRACT

A keyswitch structure includes a keycap, a base, and two supports pivotally connected to each other relative to a rotation axis and connected to and between the keycap and the base. One of the supports includes a first shaft recess, a first shaft portion, and a division slot formed therebetween; the other support includes a second shaft recess, a second shaft portion, and a division wall therebetween. The two supports are pivotally connected relative to the rotation axis by the first shaft portion and the second shaft portion rotatably disposed in the first shaft recess and the second shaft recess respectively. Therein, the division wall is inserted into the division slot. The keycap can move up and down relative to the base through the two supports.

20 Claims, 23 Drawing Sheets

(58) Field of Classification Search
CPC ..... H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS

| | | | | |
|---|---|---|---|---|
| 8,642,904 | B2 | 2/2014 | Chiba | |
| 2008/0185279 | A1 | 8/2008 | Lin | |
| 2009/0078552 | A1* | 3/2009 | Takemae | H01H 3/125 200/344 |
| 2012/0118715 | A1 | 5/2012 | Lin | |
| 2012/0292168 | A1* | 11/2012 | Chiba | H01H 3/125 200/344 |
| 2013/0078023 | A1 | 3/2013 | Yamada | |
| 2014/0116865 | A1 | 5/2014 | Leong et al. | |
| 2017/0365422 | A1 | 12/2017 | Watanabe | |
| 2018/0090287 | A1 | 3/2018 | Koshimura et al. | |
| 2019/0056794 | A1 | 2/2019 | Goldberg et al. | |
| 2020/0328047 | A1 | 10/2020 | Izawa et al. | |

FOREIGN PATENT DOCUMENTS

| | | | |
|---|---|---|---|
| CN | 201663082 | U | 12/2010 |
| CN | 202662496 | U | 1/2013 |
| CN | 202678165 | U | 1/2013 |
| CN | 102969183 | A | 3/2013 |
| CN | 202930282 | U | 5/2013 |
| CN | 103681062 | A | 3/2014 |
| CN | 104091712 | A | 10/2014 |
| CN | 104269307 | A | 1/2015 |
| CN | 104769529 | A | 7/2015 |
| CN | 105826114 | A | 8/2016 |
| CN | 104576136 | B | 7/2017 |
| CN | 207052506 | U | 2/2018 |
| CN | 107871632 | A | 4/2018 |
| CN | 207925325 | U | 9/2018 |
| CN | 108878182 | A | 11/2018 |
| CN | 109314006 | A | 2/2019 |
| CN | 109411282 | A | 3/2019 |
| JP | H11288638 | A | 10/1999 |
| JP | 2014053273 | A | 3/2014 |
| TW | 201104717 | A1 | 2/2011 |
| TW | 201611064 | A | 3/2016 |
| TW | 201640545 | A | 11/2016 |
| TW | 201705171 | A | 2/2017 |
| TW | 201735079 | A | 10/2017 |
| TW | 201735085 | A | 10/2017 |

OTHER PUBLICATIONS

CN Office Action dated Jan. 21, 2021 in Chinese application (No. 201910747531.X).
Notice of Allowance issued in U.S. Appl. No. 16/823,318, filed Mar. 18, 2020, dated Sep. 18, 2020.

* cited by examiner

KEYSWITCH STRUCTURE

CROSS REFERENCE TO RELATED APPLICATIONS

This application is a continuation application of and claims the priority benefit of U.S. patent application Ser. No. 16/823,318, filed on Mar. 18, 2020. The entirety of the above-mentioned patent application is hereby incorporated by reference herein and made a part of this specification.

BACKGROUND OF THE INVENTION

1. Field of the Invention

The present invention relates to a mechanical keyswitch structure, and more particularly to a mechanical keyswitch structure, of which the keycap is supported by and is movable through two supports.

2. Description of the Prior Art

Many mechanical keyswitch structures use a scissors support to support its keycap. The two supports of the scissors support are usually pivotally connected through a complete hole and a complete shaft formed at middle portions of the two supports fitting with each other. The hole-shaft fit can provide good relative rotation stability for the supports. However, if the two supports are pivotally connected through a complete hole-shaft structure, the two supports usually need to be assembled together along the pivot axis, or need to cross at a specific angle so as to be assembled. For automatic assembly, the above assembly ways make it difficult to adjust process and design jigs, and even to avoid excessively scraping due to misalignment, which also will affect the yield and production capacity.

U.S. Pat. No. 6,060,676 discloses two supports, of which arm distal ends has a toothed structure, respectively. The two supports are connected by meshing the two toothed structures. During a pressing operation on a keyswitch having the two supports, the engagement of the toothed structures will produce engagement and disengagement of the teeth thereof many times, which increases the instability of the keycap of the keyswitch during the pressing operation. Furthermore, in the engagement of the two toothed structures, only a few of teeth located at the zone, where the toothed structures mesh with each other, are engaged. The distal ends of the supports are still unrestricted in multiple directions. This structural configuration also will reduce the stability of the keycap.

Furthermore, when the whole keyswitch structure is reduced in size, it is difficult for the supports to provide enough space for forming a complete hole-shaft structure. Even though a complete hole-shaft structure is formed, the structural strength thereof may probably be insufficient, resulting in a reduction of the stability of the pivotal connection of the supports. Furthermore, in general, a complete hole-shaft structure may cause permanent deformation or damage to the support during assembly. When the whole keyswitch structure is reduced in size, the permanent deformation or damage probably influences the strength of the supports and the engagement stability thereof, and further influences the action stability of the keyswitch structure.

SUMMARY OF THE INVENTION

The present disclosure provides a keyswitch structure, of which supports are connected by a semi-shaft semi-hole engagement, which facilitates the assembly of the supports and can provide a pivotal connection structural strength and action stability in a certain degree.

A keyswitch structure according to the present invention includes a keycap, a base, a first support, and a second support. The base is disposed under the keycap. The first support is connected to and between the keycap and the base. The first support includes a first shaft recess and a first shaft portion. The first shaft recess and the first shaft portion extend along a rotation axis. A division slot is formed between the first shaft recess and the first shaft portion along the rotation axis. The second support is connected to and between the keycap and the base. The second support includes a second shaft recess, a second shaft portion, and a division wall. The second shaft recess and the second shaft portion extend along the rotation axis. The division wall is located between the second shaft recess and the second shaft portion. The first support and the second support are pivotally connected relative to the rotation axis by the first shaft portion and the second shaft portion being rotatably disposed in the second shaft recess and the first shaft recess respectively. Therein, the division wall is inserted into the division slot. The keycap is up and down movable through the first support and the second support relative to the base.

Compared with the prior art, the keyswitch structure according to the invention uses an incomplete hole-shaft structure and thereby can maintain the structural strength of the supports. Furthermore, each support has a shaft portion and a shaft recess. By the mutual engagement of the shaft portions and the shaft recesses, the pivotal connection thereof still can maintain the pivotal connection strength and the rotation stability in a certain degree. The two supports of the keyswitch structure according to the invention have the high stable pivotal connection configuration, and can be horizontally and automatically in an end-to-end manner, so that the lifting stroke of the keycap can have better track stability.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
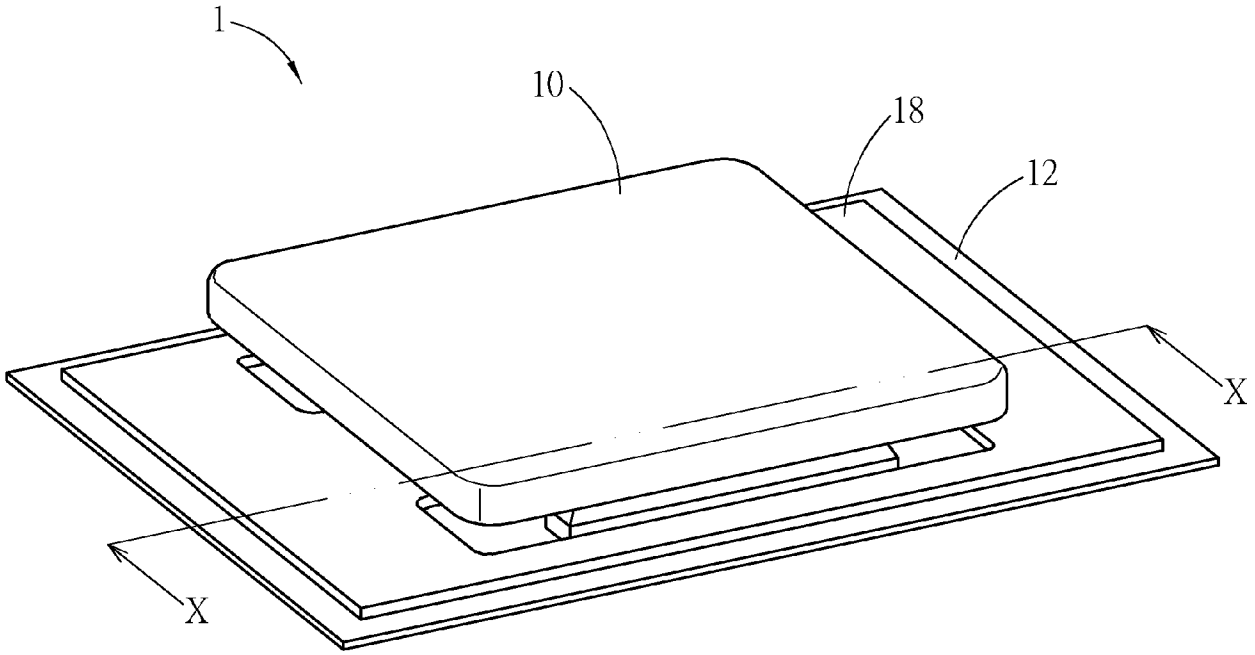
FIG. 1 is a schematic diagram illustrating a keyswitch structure according to an embodiment.
Figure 2:
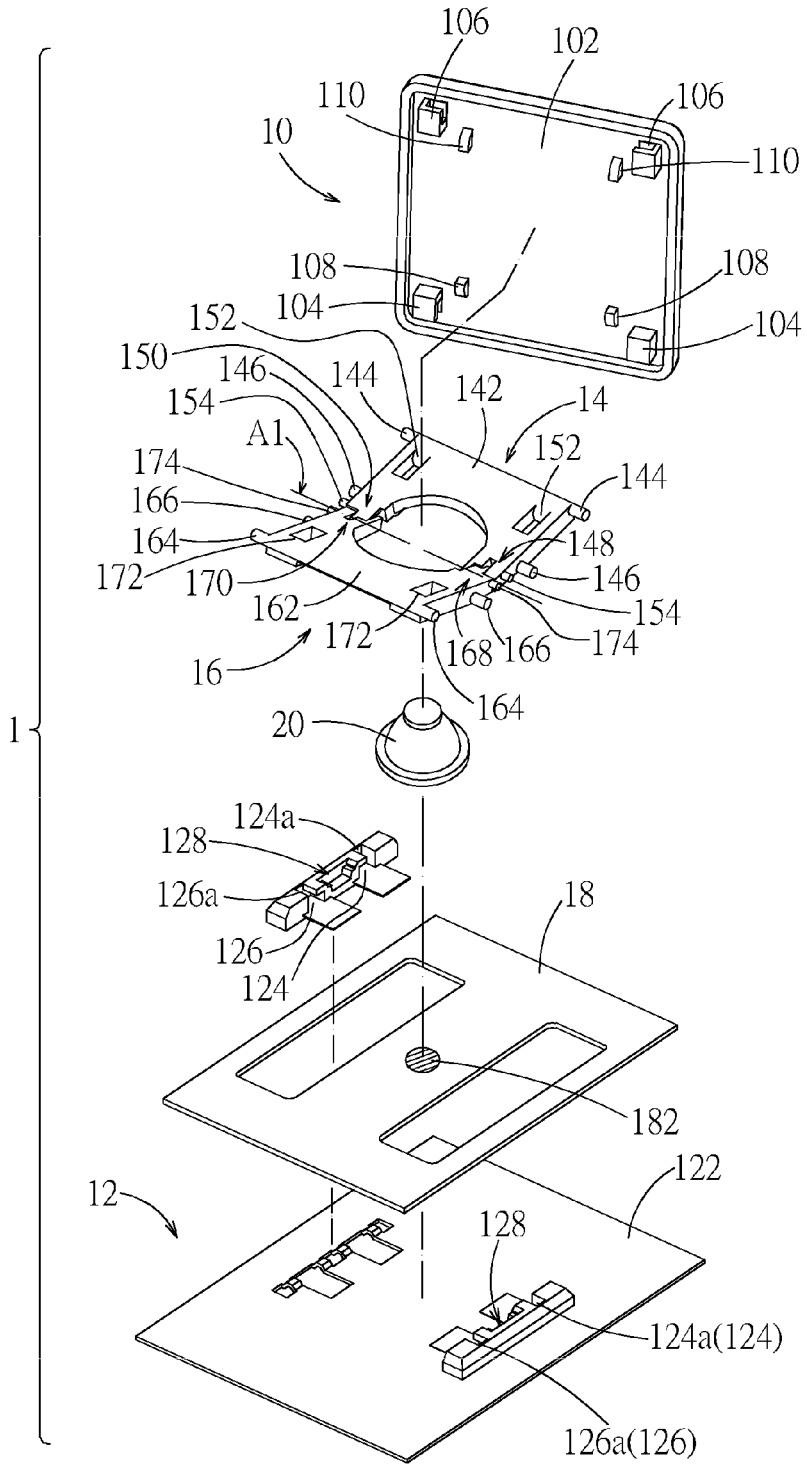
FIG. 2 is a partially exploded view of the keyswitch structure in FIG. 1.

Please refer to FIG. 1 and FIG. 2. A keyswitch structure 1 according to embodiment includes a keycap 10, a base 12, a first support 14, a second support 16, a switch circuit board 18, and a resilient restoration part 20. The base 12 is disposed under the keycap 10. The first support 14 and the second support 16 are pivotally connected relative to a rotation axis A1 (indicated by a chain line in FIG. 2) and respectively connected to and between the keycap 10 and the base 12. The switch circuit board 18 is placed on the base 12. The resilient restoration part 20 is placed on the switch circuit board 18 corresponding to a switch 182 (indicated by a circle with dashed lines in FIG. 2) of the switch circuit board 18. The keycap 10 can move up and down relative to the base 12 through the first support 14 and the second support 16. When moving down, the keycap 10 can press the resilient restoration part 20 to trigger the switch 182. In practice, the switch circuit board 18 can be but not limited to a common membrane circuit board, of which the structure details will not be described in addition. For simplification of drawing, the switch circuit board 18 is shown by a single solid part. The resilient restoration part 20 can be but not limited to a silicone or rubber dome.

Figure 3:
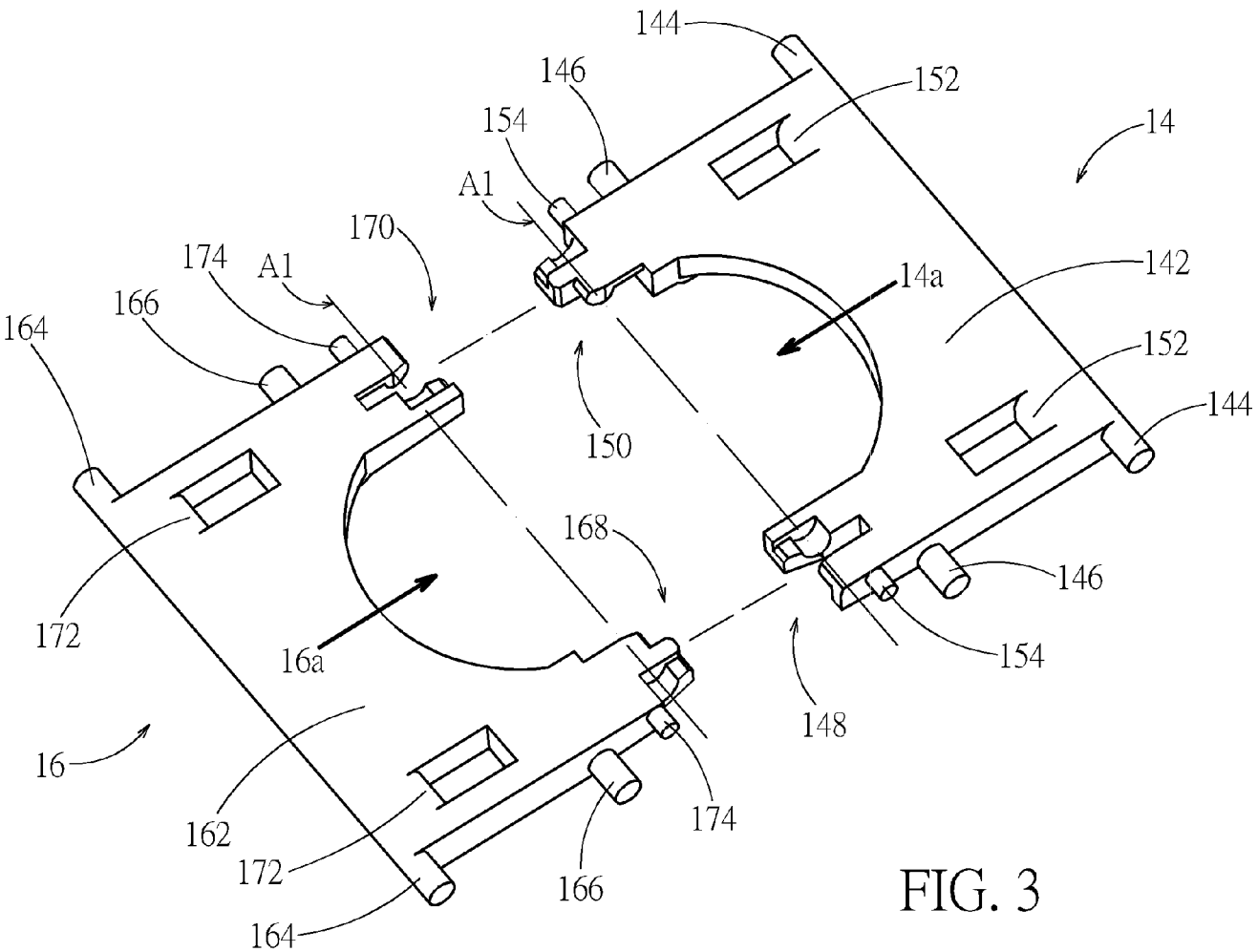
FIG. 3 is an exploded view of a first support and a second support in FIG. 2.

Please also refer to FIG. 3. The keycap 10 includes a cap body 102 and two first support connection portions 104 and two second support connection portions 106 that are disposed on the cap body 102. The base 12 includes a base plate 122 and two first sliding slots 124 and two second sliding slots 126 that are disposed on the base plate 122. The first support 14 includes a first support body 142 and two first keycap connection portions 144, two first base connection portions 146, a first pivotal connection portion 148, and a third pivotal connection portion 150 that are disposed on the first support body 142. The first support 14 is connected to the first support connection portion 104 of the keycap 10 through the first keycap connection portion 144; the first support 14 is connected to the first sliding slot 124 of the base 12 through the first base connection portion 146. The second support 16 includes a second support body 162 and two second keycap connection portions 164, two second base connection portions 166, a second pivotal connection portion 168, and a fourth pivotal connection portion 170 that are disposed on the second support body 162. The second support 16 is connected to the second support connection portion 106 of the keycap 10 through the second keycap connection portion 164; the second support 16 is connected to the first sliding slot 126 of the base 12 through the second base connection portion 166. The first pivotal connection portion 148 and the second pivotal connection portion 168 are pivotally connected. The third pivotal connection portion 150 and the fourth pivotal connection portion 170 are pivotally connected. Thereby, the first support 14 and second support 16 are pivotally connected.

Figure 4:
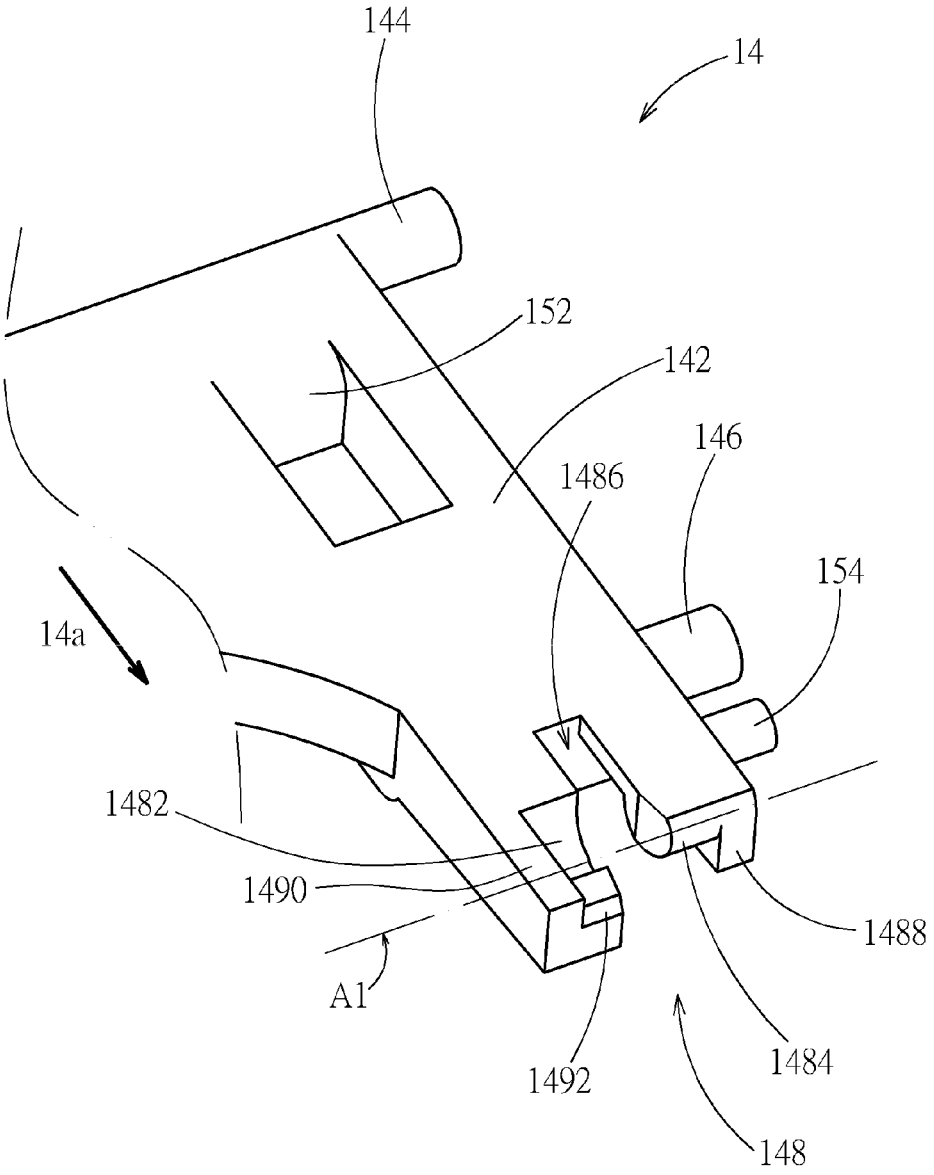
FIG. 4 is an enlarged view of a first pivotal connection portion of the first support in FIG. 3.
Figure 5:
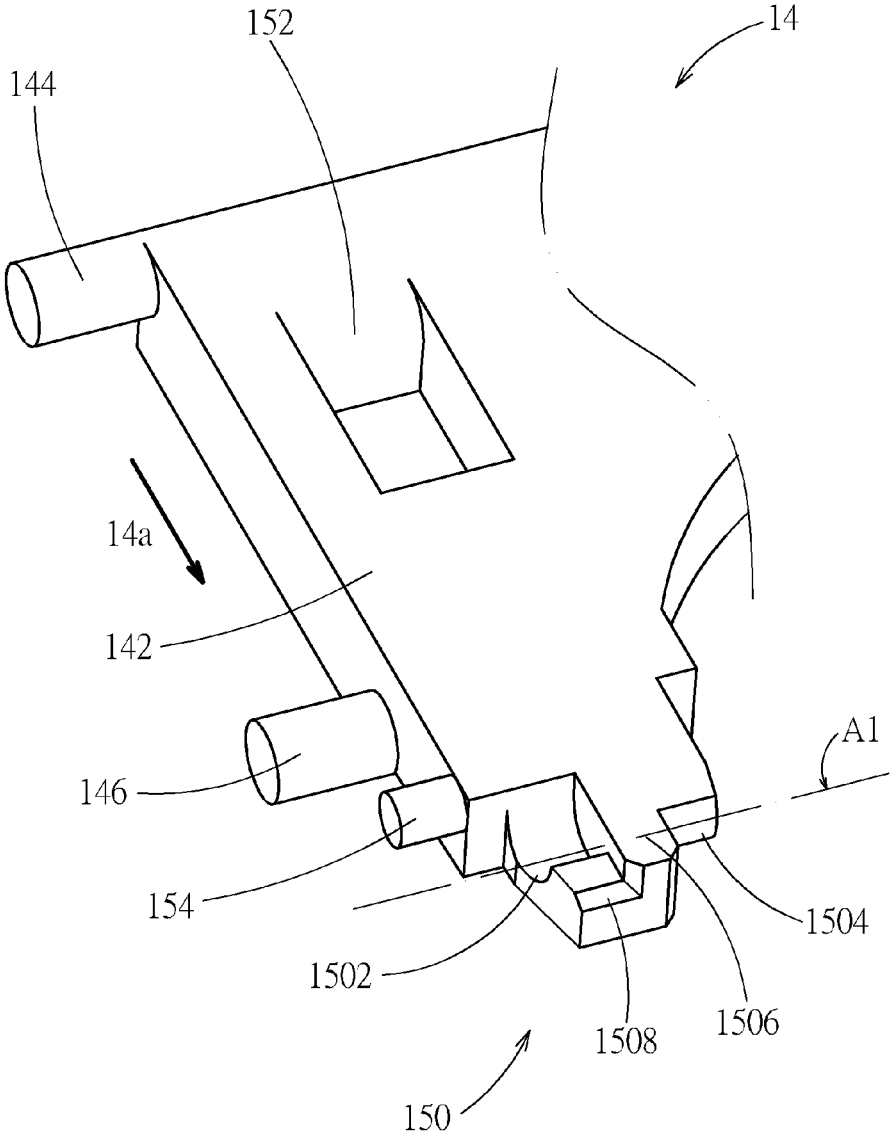
FIG. 5 is an enlarged view of a third pivotal connection portion of the first support in FIG. 3.

Further, please refer to FIG. 2, FIG. 3 and FIG. 5. In the embodiment, the first support body 142 shows an n-shaped structure. The two first keycap connection portions 144 and the two first base connection portions 146 are located at two opposites of the n-shaped structure relative to a direction perpendicular to the rotation axis A1. The first pivotal connection portion 148 and the third pivotal connection portion 150 are located at outer sides of two end portions of the n-shaped structure (i.e. end portions of arms of the n-shaped structure) respectively (in other embodiments, the pivotal connection portions 148 and 150 may be located at inner sides of the two end portions of the n-shaped structure according to the disposition of the first sliding slot 124). The first base connection portion 146 is located between the first keycap connection portion 144 and the first pivotal connection portion 148 (and the third pivotal connection portion 150) (i.e. located between the first keycap connection portion 144 and the rotation axis A1). The first support 14 and the keycap 10 are rotatably connected through the first keycap connection portion 144 and the first support connection portion 104. Therein, the first support connection portion 104 shows a sliding slot structure. The first keycap connection portion 144 shows a post structure that extends parallel to the rotation axis A1 from the first support body 142 and is slidably disposed in the first support connection portion 104. The first support 14 and the base 12 are rotatably connected through the first base connection portion 146 and the first sliding slot 124. Therein, the first sliding slot 124 extends parallel to the base plate 122 and perpendicular to the rotation axis A1. The first base connection portion 146 shows a post structure that extends parallel to the rotation axis A1 from the first support body 142 and is slidably disposed in the first sliding slot 124. The first pivotal connection portion 148 includes a first shaft recess 1482 and a first shaft portion 1484 that extend along the rotation axis A1. The first shaft recess 1482 and the first shaft portion 1484 are arranged separate along the rotation axis A1 so as to from a first division slot 1486 (i.e. the space that extends along the rotation axis A1 between the first shaft recess 1482 and the first shaft portion 1484). The first shaft recess 1482 and the first shaft portion 1484 coaxially coincide with the rotation axis A1 (i.e. the coaxial axis thereof coincides with the rotation axis A1), which is conducive to the rotation stability of the first support 14. The third pivotal connection portion 150 includes a third shaft recess 1502, a third shaft portion 1504, and a second division wall 1506. The third shaft recess 1502 and the third shaft portion 1504 extend along the rotation axis A1. The second division wall 1506 (i.e. a wall that extends perpendicular to the rotation axis A1) is connected to and between the third shaft recess 1502 and the third shaft portion 1504. Similarly, the third shaft recess 1502 and the third shaft portion 1504 coaxially coincide with the rotation axis A1 (i.e. the coaxial axis thereof coincides with the rotation axis A1), which is conducive to the rotation stability of the first support 14. Along the rotation axis A1, the first shaft portion 1484 and the first shaft recess 1482 face opposite directions (e.g. in the view point of FIG. 4, facing the lower left side and the upper right side respectively), and extend toward each other. The third shaft recess 1502 and the third shaft portion 1504 also face opposite directions (e.g. in the view point of FIG. 5, facing the upper right side and the lower left side respectively) along the rotation axis A1, and extend relatively away from each other.

Please refer to FIG. 2, FIG. 3, FIG. 6 and FIG. 7. In the embodiment, the second support body 142 shows an n-shaped structure. The two second keycap connection portions 164 and the two second base connection portions 166 are located at two opposites of the n-shaped structure relative to a direction perpendicular to the rotation axis A1. The second pivotal connection portion 168 and the fourth pivotal connection portion 170 are located at outer sides of two end portions of the n-shaped structure (i.e. end portions of arms of the n-shaped structure) respectively (or at inner sides of the two end portions of the n-shaped structure). The second base connection portion 166 is located between the second keycap connection portion 164 and the second pivotal connection portion 168 (and the fourth pivotal connection portion 170) (i.e. located between the second keycap connection portion 164 and the rotation axis A1). The second support 16 and the keycap 10 are rotatably connected through the second keycap connection portion 164 and the second support connection portion 106. Therein, the second support connection portion 106 shows a sliding slot structure. The second keycap connection portion 164 shows a post structure that extends parallel to the rotation axis A1 from the second support body 162 and is slidably disposed in the second support connection portion 106. The second support 16 and the base 12 are rotatably connected through the second base connection portion 166 and the second sliding slot 126. Therein, the second sliding slot 126 extends parallel to the base plate 122 and perpendicular to the rotation axis A1. The second base connection portion 166 shows a post structure that extends parallel to the rotation axis A1 from the second support body 162 and is slidably disposed in the second sliding slot 126. The second pivotal connection portion 168 includes a second shaft recess 1682, a second shaft portion 1684, and a first division wall 1686. The second shaft recess 1682 and the second shaft portion 1684 extend along the rotation axis A1. The first division wall 1686 (i.e. a wall that extends perpendicular to the rotation axis A1) is connected to and between the second shaft recess 1682 and the second shaft portion 1684. The second shaft recess 1682 and the second shaft portion 1684 coaxially coincide with the rotation axis A1 (i.e. the coaxial axis thereof coincides with the rotation axis A1), which is conducive to the rotation stability of the second support 16. The fourth pivotal connection portion 170 includes a fourth shaft recess 1702 and a fourth shaft portion 1704 that extend along the rotation axis A1. The fourth shaft recess 1702 and the fourth shaft portion 1704 are arranged separate along the rotation axis A1 so as to from a second division slot 1706 (i.e. the space that extends along the rotation axis A1 between the fourth shaft recess 1702 and the fourth shaft portion 1704). Similarly, the fourth shaft recess 1702 and the fourth shaft portion 1704 coaxially coincide with the rotation axis A1 (i.e. the coaxial axis thereof coincides with the rotation axis A1), which is conducive to the rotation stability of the second support 16. Along the rotation axis A1, the second shaft portion 1684 and the second shaft recess 1682 face opposite directions (e.g. in the view point of FIG. 6, facing the lower right side and the upper left side respectively), and extend relatively away from each other. The fourth shaft portion 1704 and the fourth shaft recess 1702 also face opposite directions (e.g. in the view point of FIG. 7, facing the upper left side and the lower right side respectively) along the rotation axis A1, and extend toward each other.

Please refer to FIG. 3 to FIG. 7. The first shaft portion 1484 is rotatably disposed in the second shaft recess 1682. The second shaft portion 1684 is rotatably disposed in the first shaft recess 1482. Thereby, the first pivotal connection portion 148 and the second pivotal connection portion 168 are pivotally connected relative to the rotation axis A1. Therein, the first division wall 1486 is inserted into the first division slot 1686. The third shaft portion 1504 is rotatably disposed in the fourth shaft recess 1702. The fourth shaft portion 1704 is rotatably disposed in the third shaft recess 1502. Thereby, the third pivotal connection portion 150 and the fourth pivotal connection portion 170 are pivotally connected relative to the rotation axis A1. Therein, the second division wall 1506 is inserted into the second division slot 1706. For the first support 14 and the second support 16 as a whole, in the top view of the keyswitch structure 1, the first support 14 and the second support 16 are connected to form a rectangle structure. The resilient restoration part 20 passes through the rectangle structure to abut against the keycap 10. In the side view of the keyswitch structure 1, when the keycap 10 is not pressed, the first support 14 and the second support 16 are connected to form a V-shaped structure.

Furthermore, in the embodiment, the first pivotal connection portion 148 includes a first shaft side wall 1488 and a first recess side wall 1490 (e.g. respectively a wall that extends perpendicular to the rotation axis A1). The first shaft side wall 1488 is connected to the first shaft portion 1484 opposite to the first shaft recess 1482. The first recess side wall 1490 is connected to the first shaft recess 1482 opposite to the first shaft portion 1484. That is, the first recess side wall 1490, the first shaft recess 1482, the first division slot 1486, the first shaft portion 1484, and the first shaft side wall 1488 are arranged in order along the rotation axis A1. The first shaft side wall 1488 and the first recess side wall 1490 can increase the structure strength of the first shaft portion 1484 and the first shaft recess 1482 respectively. The first shaft side wall 1488 and the first recess side wall 1490 also have the positioning effect on the second shaft recess 1682 and the second shaft portion 1684. The first division wall 1686 can increase the structure strength of the second shaft recess 1682 and the second shaft portion 1684, and also has the positioning effect on the second shaft recess 1682 and the second shaft portion 1684 in coordination with the first division slot 1486.

Similarly, the fourth pivotal connection portion 170 includes a second shaft side wall 1708 and a second recess side wall 1710 (e.g. respectively a wall that extends perpendicular to the rotation axis A1). The second shaft side wall 1708 is connected to the fourth shaft portion 1704 opposite to the fourth shaft recess 1702. The second recess side wall 1710 is connected to the fourth shaft recess 1702 opposite to the fourth shaft portion 1704. That is, the second recess side wall 1710, the fourth shaft recess 1702, the second division slot 1706, the fourth shaft portion 1704, and the second shaft side wall 1708 are arranged in order along the rotation axis A1. The second shaft side wall 1708 and the second recess side wall 1710 can increase the structure strength of the second shaft portion 1704 and the fourth shaft recess 1702 respectively. The second shaft side wall 1708 and the second recess side wall 1710 also have the positioning effect on the third shaft recess 1502 and the third shaft portion 1504. The second division wall 1506 can increase the structure strength of the third shaft recess 1502 and the third shaft portion 1504, and also has the positioning effect on the fourth shaft recess 1702 and the fourth shaft portion 1704 in coordination with the second division slot 1706.

Furthermore, in the embodiment, a first extension direction 14*a* (indicated by an arrow in FIG. 3 to FIG. 5, i.e. the direction the two side arms of the first support 14 point in) is defined as pointing from the first keycap connection portion 144 to the first base connection portion 146. The first pivotal connection portion 148 has a first guiding surface 1492 disposed at a distal end of the first support body 142 close to the first shaft recess 1462 in the extension direction 14*a* and extending parallel to the rotation axis A1. The outer portion of the first guiding surface 1492 is relatively low; the inner portion of the first guiding surface 1492 is relatively high. This structural configuration is convenient for the second shaft portion 1684 to fit into the first shaft recess 1482. The inner edge of the first guiding surface 1492 performs a restriction in the first extension direction 14*a* on the second shaft portion 1684 located in the first shaft recess 1482. Similarly, a second extension direction 16*a* (indicated by an arrow in FIG. 3, FIG. 6 and FIG. 7, i.e. the direction the two side arms of the second support 16 point in) is defined as pointing from the second keycap connection portion 164 to the second base connection portion 166. The second pivotal connection portion 168 has a second guiding surface 1688 disposed at a distal end of the second support body 162 close to the second shaft recess 1682 in the extension direction 14*a* and extending parallel to the rotation axis A1. The outer portion of the second guiding surface 1688 is relatively low; the inner portion of the second guiding surface 1688 is relatively high. This structural configuration is convenient for the first shaft portion 1484 to fit into the second shaft recess 1682. The inner edge of the second guiding surface 1688 performs a restriction in the second extension direction 16*a* on the first shaft portion 1484 located in the second shaft recess 1682. Furthermore, in the embodiment, the first shaft portion 1484 and the second shaft portion 1684 are realized by (incomplete) cylinders, which have a guiding effect, so in practice, the first guiding surface 1492 and the second guiding surface 1688 can be Omitted.

Similarly, the third pivotal connection portion 148 has a third guiding surface 1508 disposed at a distal end of the first support body 142 close to the third shaft recess 1502 in the extension direction 14*a* and extending parallel to the rotation axis A1. The outer portion of the third guiding surface 1508 is relatively low; the inner portion of the third guiding surface 1508 is relatively high. This structural configuration is convenient for the fourth shaft portion 1704 to fit into the third shaft recess 1502, and provides a restriction in a direction perpendicular to the rotation axis A1. Similarly, the fourth pivotal connection portion 170 has a fourth guiding surface 1712 disposed at a distal end of the second support body 162 close to the fourth shaft recess 1702 in the second extension direction 16*a* and extending parallel to the rotation axis A1. The outer portion of the fourth guiding surface 1712 is relatively low; the inner portion of the fourth guiding surface 1712 is relatively high. This structural configuration is convenient for the third shaft portion 1504 to fit into the fourth shaft recess 1702, and provides a restriction in a direction perpendicular to the rotation axis A1. Furthermore, in the embodiment, the third shaft portion 1504 and the fourth shaft portion 1704 are realized by (incomplete) cylinders, which have a guiding effect, so in practice, the third guiding surface 1508 and the fourth guiding surface 1712 can be Omitted.

Furthermore, in the embodiment, the first shaft portion 1484 is realized by an incomplete cylinder (extending along the rotation axis A1). The second shaft recess 1682 is realized by an incomplete round trough surface (extending along the rotation axis A1). The first shaft portion 1484 and the second shaft recess 1682 slidably surface contact each other; one of the first shaft portion 1484 and the second shaft recess 1682 has a contact surface. The contract surface extends along the rotation axis A1 and extends at a center angle of at least 180 degrees relative to the rotation axis A1. However, in practice, the slidable contact of the first shaft portion 1484 and the second shaft recess 1682 can be realized by multiple line contacts. For example, the first shaft portion 1484 is modified to have a plurality of protruding ribs that extend along the rotation axis A1. In logic, the distal ends of the protruding ribs line contact the second shaft recess 1682 (or the curved surface thereof, e.g. the semi-hole surface extending around the rotation axis A1). The above descriptions also apply to the contact relationships between the second shaft portion 1684 and the first shaft recess 1482, between the third shaft portion 1504 and the fourth shaft recess 1702, and between the fourth shaft portion 1704 and the third shaft recess 1502, which will not be described in addition. Furthermore, in practice, the contact relationships between the first shaft portion 1484 and the second shaft recess 1682, between the second shaft portion 1684 and the first shaft recess 1482, between the third shaft portion 1504 and the fourth shaft recess 1702, and between the fourth shaft portion 1704 and the third shaft recess 1502 are not limited to be the same.

Please refer to FIG. 2. In the embodiment, one plastic part structurally integrates one first sliding slot 124 and one second sliding slot 126. The plastic part can be joined to the base plate 122 (e.g. but not limited to a metal plate) by insert molding, or the plastic part can be formed by injection molding and then joined with the base plate 122 by riveting (e.g. by heating and shaping posts of the plastic part that pass through the base plate 122). However, in practice, the base 12 can be formed by stamping a single metal plate, which will not be described in addition. The first sliding slot 124 and the second sliding slot 126 are structurally opposite. Therein, the first sliding slot 124 extends parallel to the base plate 122 and has first inlet 124*a*. The second sliding slot 126 extends parallel to the base plate 122 and has a second inlet 126*a*. When assembling the first support 14 and the second support 16 to the base 12, the first base connection portion 146 and the second base connection portion 166 can be first put in the first inlet 124*a* and the second inlet 126*a* respectively. Then, the first support 14 and the second support 16 can be horizontally end-to-end assembled by jigs and automation equipment so as to achieve the pivotal connection of the first support 14 and the second support 16. Therein, the first pivotal connection portion 148 and the second pivotal connection portion 168 are horizontally aligned (e.g. simply by horizontally placing the first support 14 and the second support 16). Then, the first support 14 and the second support 16 are horizontally end-to-end moved (i.e. end portions of side arms thereof being opposite to each other) to approach each other (i.e. parallel to the first extension direction 14*a* and the second extension direction 16*a*, i.e. perpendicular to the rotation axis A1) until the pivotal connection portion 148 and the second pivotal connection portion 168 are engaged (i.e. the first shaft portion 1484 fitting in the second shaft recess 1682, the second shaft portion 1684 fitting in the first shaft recess 1482) and the third pivotal connection portion 150 and the fourth pivotal connection portion 170 are engaged (i.e. the third shaft portion 1504 fitting in the fourth shaft recess 1702, the fourth shaft portion 1704 fitting in the third shaft recess 1502). Thereby, the pivotal connection of the first support 14 and the second support 16 is completed. The first shaft recess 1482, the first shaft portion 1484, the second shaft recess 1682, the second shaft portion 1684, the third shaft recess 1502, the third shaft portion 1504, the fourth shaft recess 1702, and the fourth shaft portion 1704 coaxially coincide with the rotation axis A1 (i.e. the coaxial axis thereof coincides with the rotation axis A1), which is conducive to the rotation stability of the first support 14. Accordingly, the first base connection portion 146 and the second base connection portion 166 are slidably disposed in the first sliding slot 124 and the second sliding slot 126 respectively. In practice, the first shaft side wall 1488 and the first recess side wall 1490 can be removed for increasing the structural elasticity of the first shaft recess 1482 and the second shaft portion 1484, which is conducive to the above horizontal engagement of the first pivotal connection portion 148 and the second pivotal connection portion 168. Similarly, the second shaft side wall 1708 and the second recess side wall 1710 can be removed for increasing the structural elasticity of the fourth shaft recess 1702 and the fourth shaft portion 1704, which is conducive to the above horizontal engagement of the third pivotal connection portion 150 and the fourth pivotal connection portion 170.

Furthermore, in practice, the first support 14 and the second support 16 can be pivotally connected with each other and then be engaged with the base 12. For the former, for example, the first support 14 and the second support 16 are posed perpendicular to each other, which is convenient to engage the first pivotal connection portion 148 with the second pivotal connection portion 168. For the latter, for example, the first base connection portion 146 and the second base connection portion 166 can be forced into the first sliding slot 124 and the second sliding slot 126 respectively. For another example, the first support 14 and the second support 16 are compressed and deformed along the rotation axis A1 so that the first base connection portion 146 and the second base connection portion 166 can enter the first sliding slot 124 and the second sliding slot 126 respectively; in this case, the first sliding slot 124 and the second sliding slot 126 are not limited to have the first inlet 124*a* and the second inlet 126*a*. When the first sliding slot 124 and the second sliding slot 126 are provided without inlet structure, or the distance between the first inlet 124*a* and the second inlet 126*a* is so large that the first support 14 and the second support 16 need to be disposed in the first sliding slot 124 and the second sliding slot 126 respectively and then engage with each other, the first sliding slot 124 and the second sliding slot 126 can be provided with a longer sliding way. Thereby, the first base connection portion 146 and the second base connection portion 166 can stably slide and rotate in the first sliding slot 124 and the second sliding slot 126 respectively, which is conducive to the action of the keyswitch structure 1.

Figure 7:
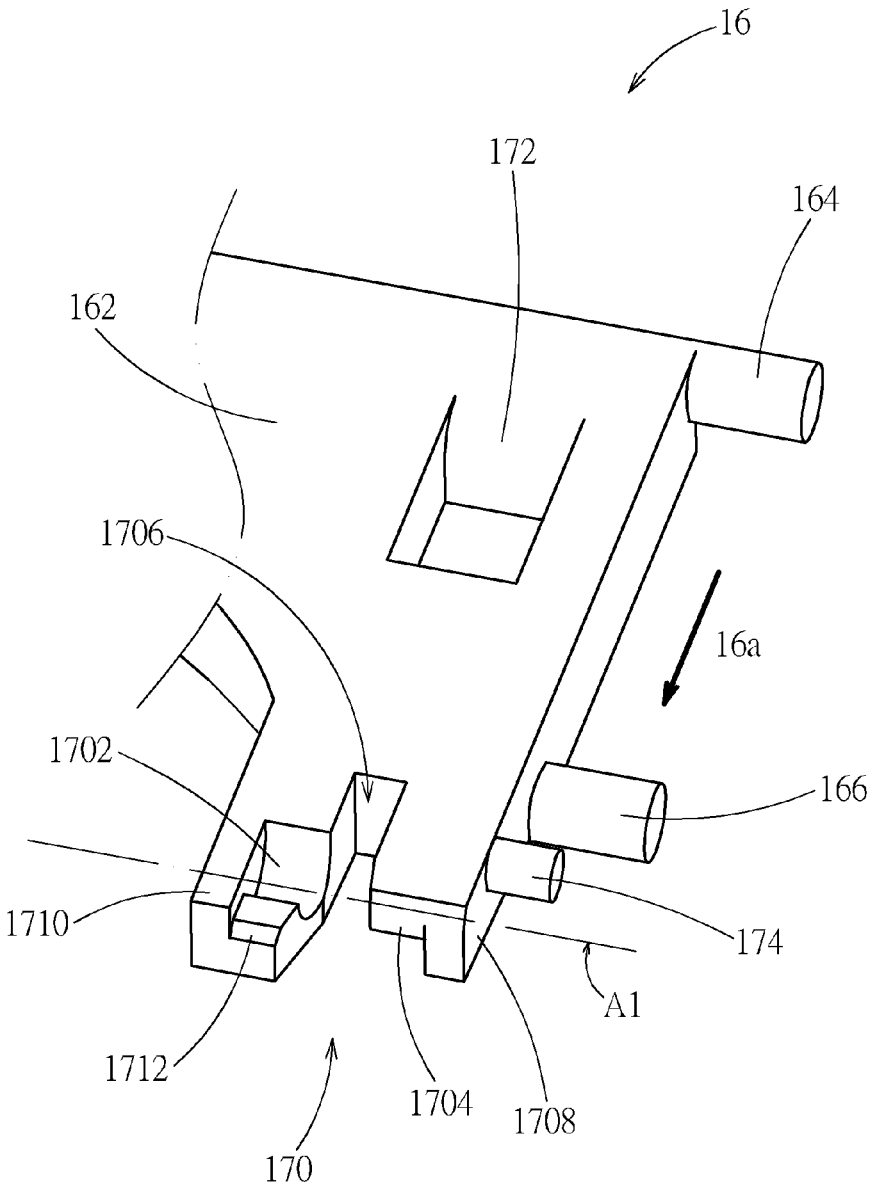
FIG. 7 is an enlarged view of a fourth pivotal connection portion of the second support in FIG. 3.
Figure 8:
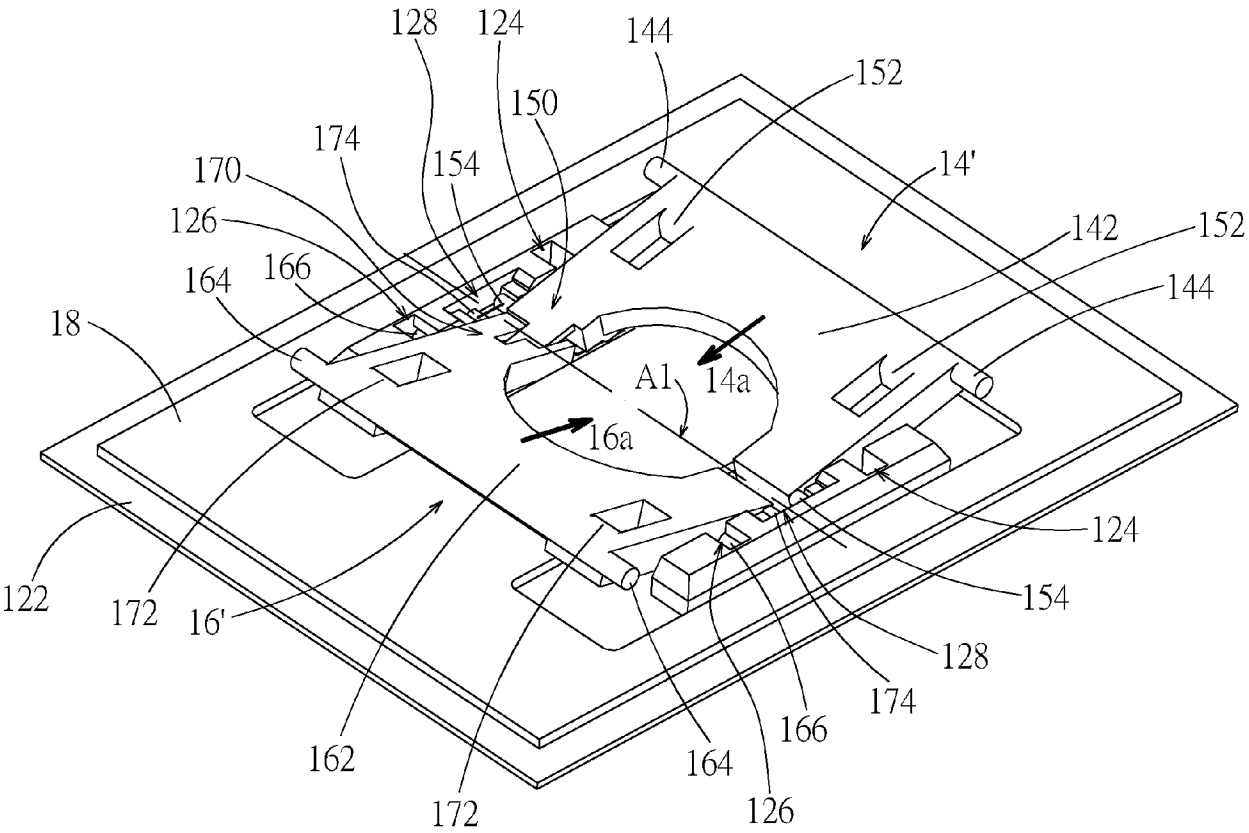
FIG. 8 is a schematic diagram illustrating the connection of the first support and the second support according to an embodiment.

As described above, in the embodiment, as shown by FIG. 3 to FIG. 7, the first support 14 and the second support 16 have the same structure. Therein, the first pivotal connection portion 148 and the fourth pivotal connection portion 170 have the same structure, and the third pivotal connection portion 150 and the second pivotal connection portion 168 have the same structure. The structural design can reduce the production cost of the keyswitch structure 1; however, it is not limited thereto in practice. For example, in the first support 14, it is practicable for the third pivotal connection portion 150 and the first pivotal connection portion 148 to have the same structure. Correspondingly, in the second support 16, it is practicable for the fourth pivotal connection portion 170 and the second pivotal connection portion 168 to have the same structure. For another example, it is practicable to connect the third pivotal connection portion 150 and the fourth pivotal connection portion 170 by other common pivotal connection structures (e.g. common hole-shaft fittings, or other engagement structures capable of rotating relatively). For another example, the first support 14 and the second support 16 are pivotally connected through one set of pivotal connection portions. As shown by FIG. 8, the first support 14' and the second support 16' are pivotally connected through the third pivotal connection portion 150 and the fourth pivotal connection portion 170. Therein, the first support 14' is equivalent to the above first support 14 without the first pivotal connection portion 148; the second support 16' is equivalent to the above second support 16 without the second pivotal connection portion 168. Furthermore, in the embodiment, the first support 14 and the second support 16 are pivotally connected in a V-shaped structural configuration. However, in practice, it is practicable to modify the structures of the first support 14 and the second support 16 so that the first support 14 and the second support 16 can be pivotally connected in an X-shaped structural configuration. For example, the first pivotal connection portion 146 is modified to be located between the first keycap connection portion 142 and the first base connection portion 144; the second pivotal connection portion 166 is modified to be located between the second keycap connection portion 162 and the second base connection portion 164.

Figure 6:
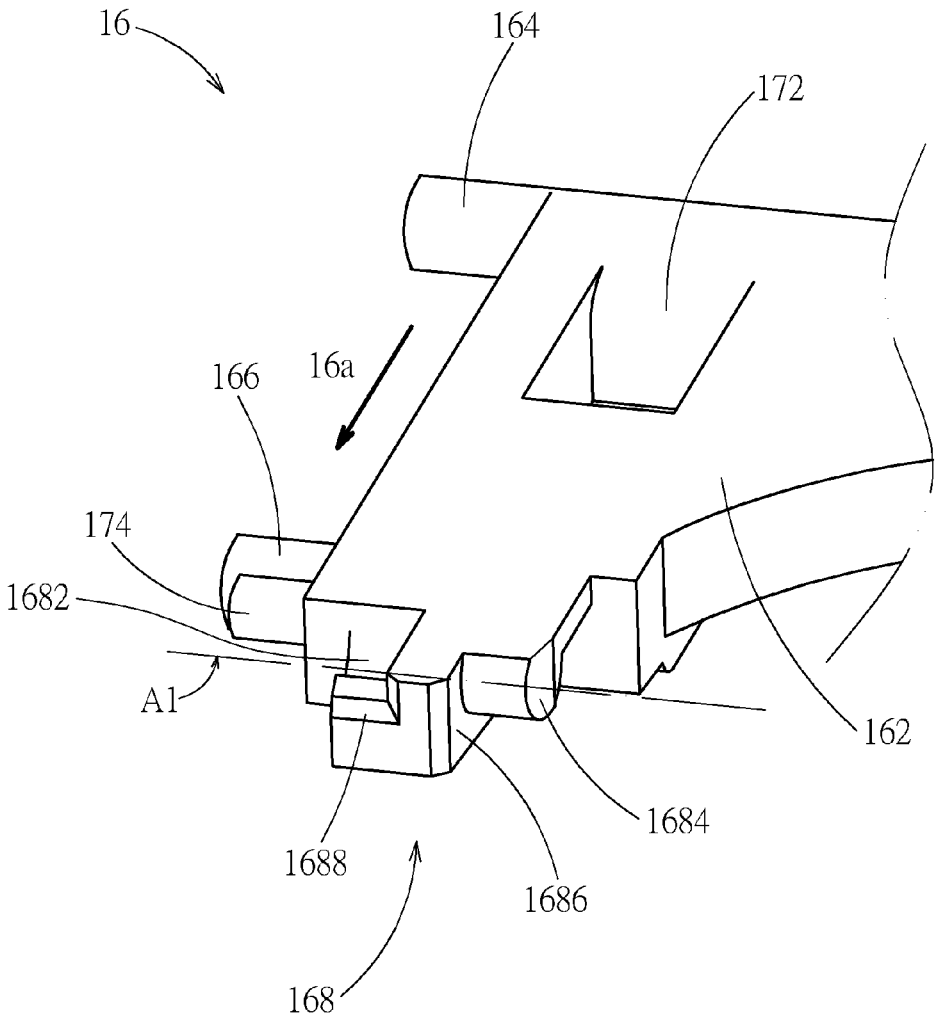
FIG. 6 is an enlarged view of a second pivotal connection portion of the second support in FIG. 3.
Figure 9:
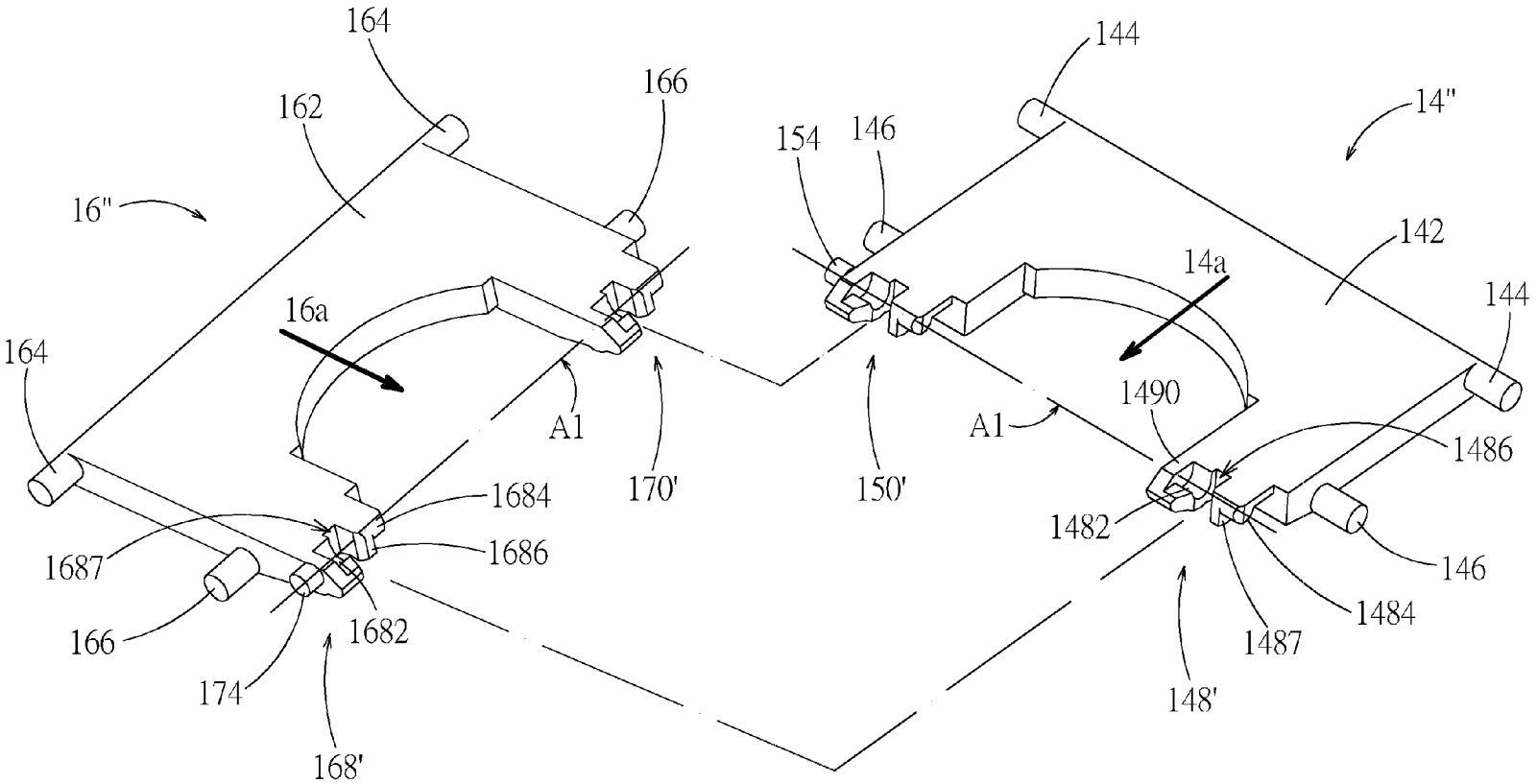
FIG. 9 is an exploded view of a first support and a second support according to another embodiment.
Figure 10:
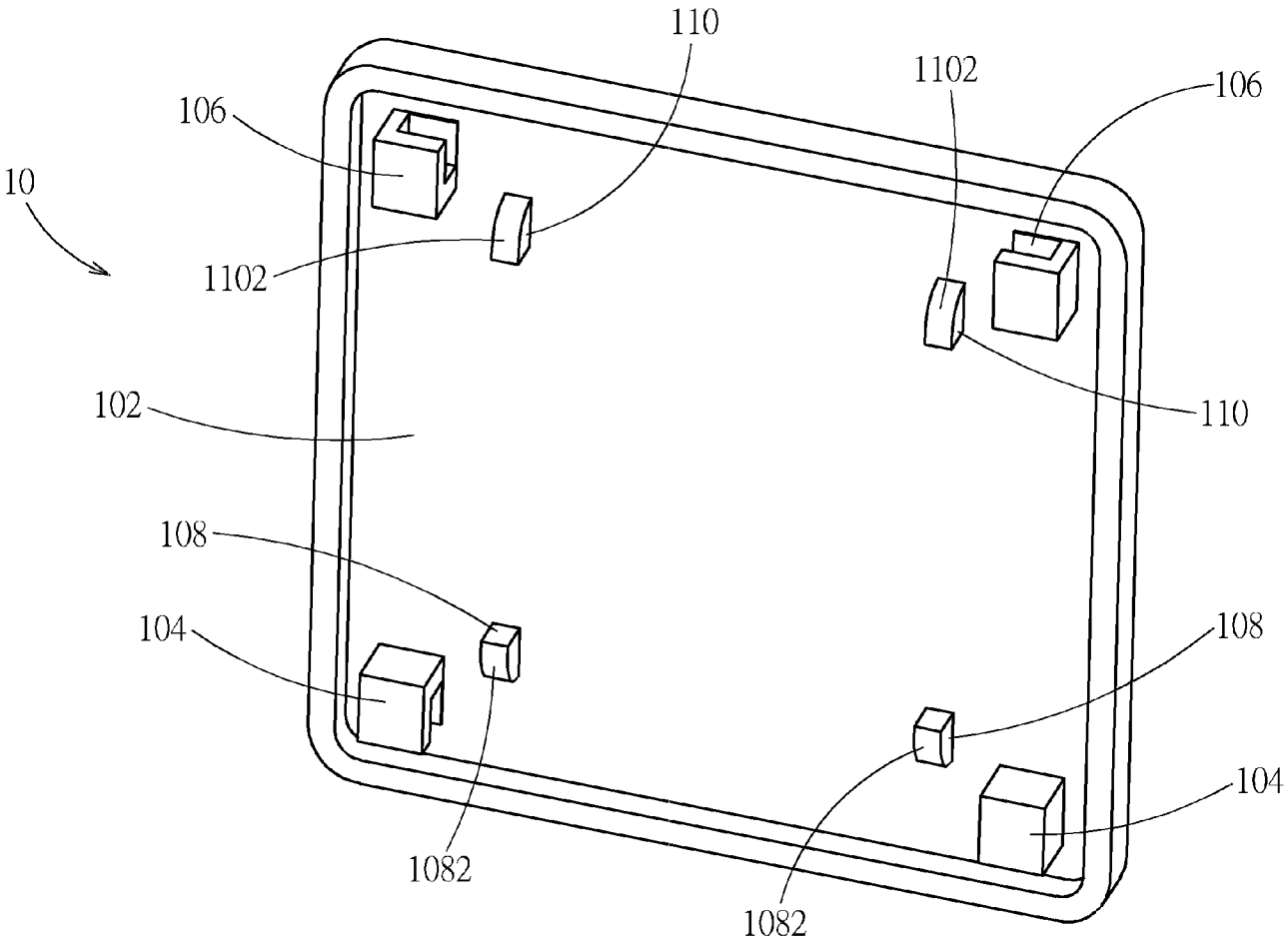
FIG. 10 is a schematic diagram illustrating a keycap in FIG. 2.
Figure 11:
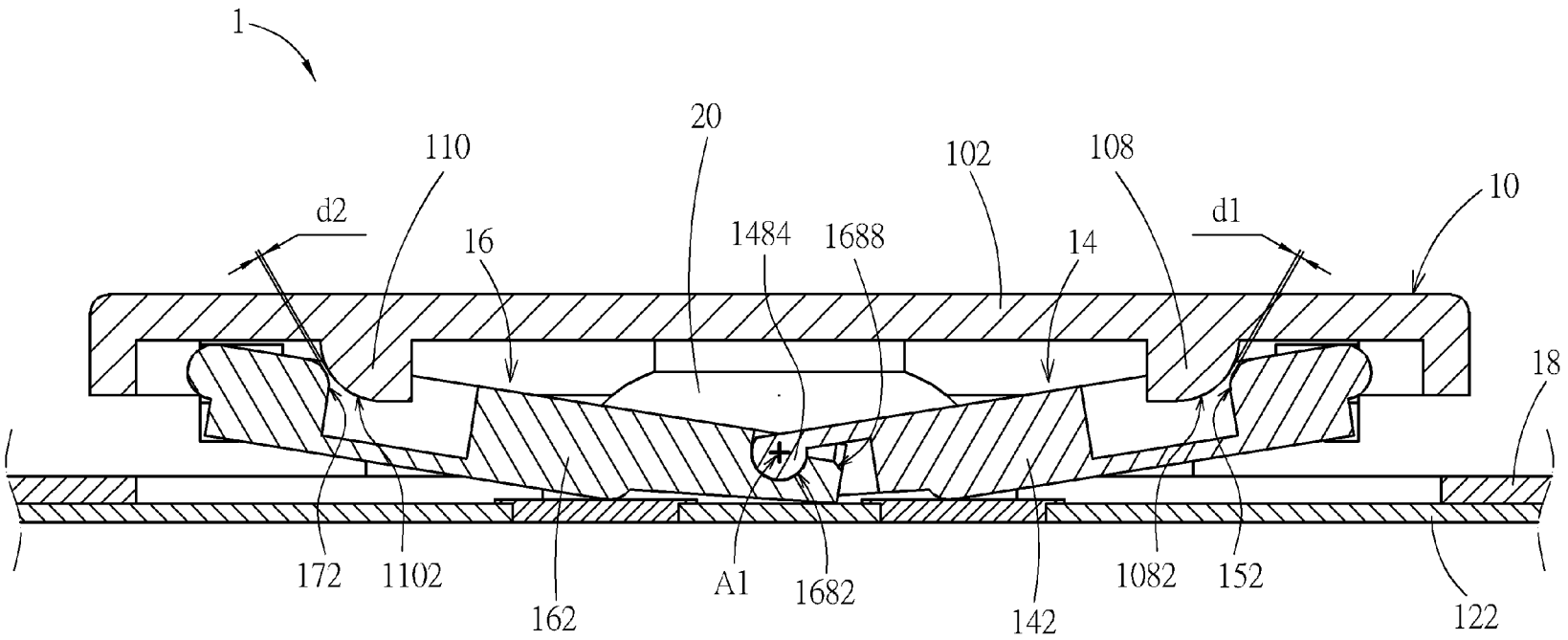
FIG. 11 is a sectional view of the keyswitch structure along the line X-X.
Figure 12:
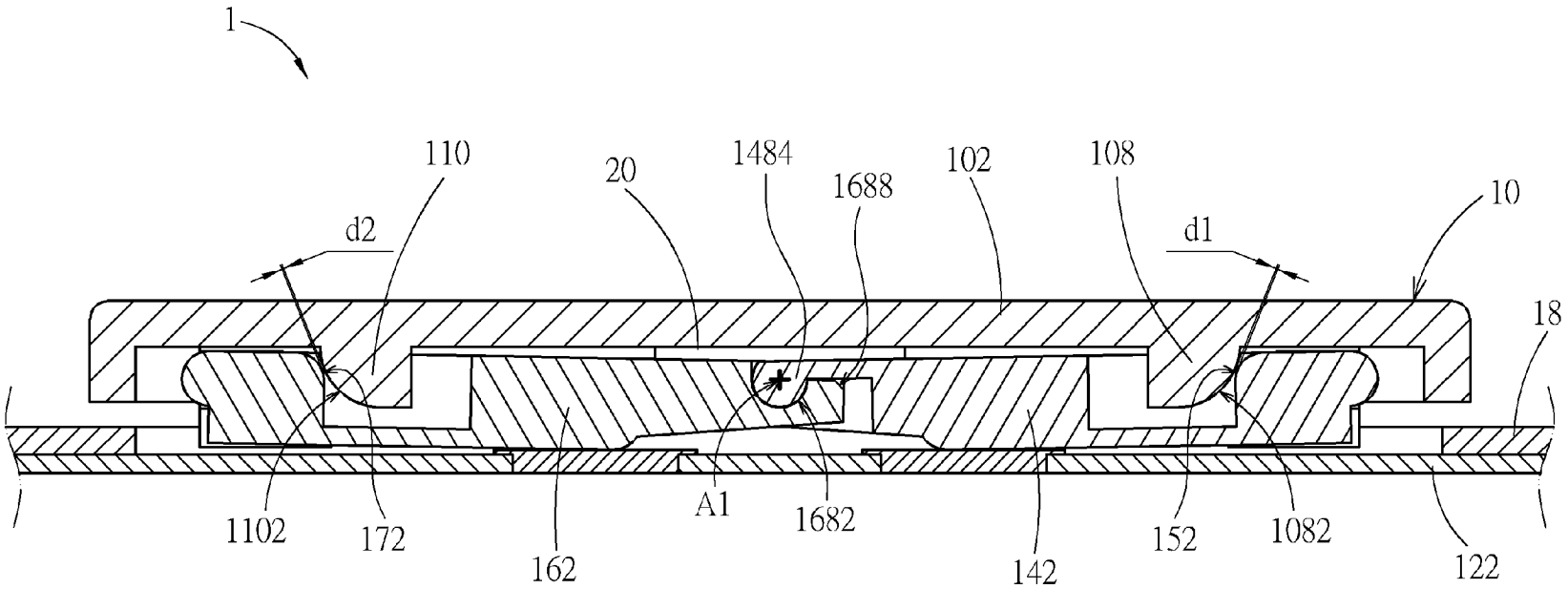
FIG. 12 is a sectional view of the keyswitch structure in FIG. 11 when the keycap is pressed down.

In addition, in the embodiment, the connection of the first pivotal connection portion 148 and the second pivotal connection portion 168 includes a slot-to-wall positioning structure (i.e. the first division slot 1486 in coordination with the first division wall 1686); however, it is not limited thereto in practice. As shown by FIG. 9, compared with the first pivotal connection portion 148 of the first support 14 (as shown by FIG. 3 to FIG. 5), the first pivotal connection portion 148' of the first support 14" further includes an adjacent division wall 1487 adjacent to the first division slot 1486. Correspondingly, compared with the second pivotal connection portion 168 of the second support 16 (as shown by FIG. 3, FIG. 6 and FIG. 7), the second pivotal connection portion 168' of the second support 16" further includes an adjacent division slot 1687 adjacent to the first division wall 1686. In other words, the first division slot 1486 and the adjacent division wall 1487 are located between the first shaft recess 1482 and the first shaft portion 1484, and the first division wall 1686 and the adjacent division slot 1687 are located between the second shaft recess 1682 and the second shaft portion 1684. Along the rotation axis A1, the first shaft portion 1484 and the first shaft recess 1482 of the first pivotal connection portion 148' face the same direction (in the view point of FIG. 9, facing the lower right side), and the shaft portion and the shaft recess of the third pivotal connection portion 150' also face the same direction. Similarly, along the rotation axis A1, the second shaft recess 1682 and the second shaft portion 1684 of the second pivotal connection portion 168' face the same direction (in the view point of FIG. 9, facing the upper right side), and the shaft portion and the shaft recess of the fourth pivotal connection portion 170' also face the same direction. By rotatably disposed the first shaft portion 1484 in the second shaft recess 1682, the second shaft portion 1684 is rotatably disposed in the first shaft recess 1482, the first division wall 1486 is inserted into the first division slot 1686, and the division wall 1487 is inserted into the division slot 1687, so that the first pivotal connection portion 148' and the second pivotal connection portion 168' are pivotally connected. Furthermore, in the embodiment, the third pivotal connection portion 150' and the first pivotal connection portion 148' of the first support 14" have the same structure. The fourth pivotal connection portion 170' and the second pivotal connection portion 168' of the second support 16" have the same structure. The first support 14" and the second support 16" have the same structure. The structural design can reduce the production cost; however, it is not limited thereto in practice. Furthermore, for descriptions about variations of the first support 14" and the second support 16", please refer to the relevant descriptions of the variations of the first support 14 and the second support 16 in the foregoing, which will not be described in addition.

Please refer to FIG. 2, FIG. 3, and FIG. 10 to FIG. 12. The keycap 102 includes two first limitation protrusions 108 and two second limitation protrusions 110 disposed on the keycap 102. The two first limitation protrusions 108 are close to the two first support connection portion 104 and between the two first support connection portions 104. The two second limitation protrusions 110 are close to the two second support connection portions 106 and between the two second support connection portions 106. The first support 14 includes two first surface limitation structures 152 disposed on the first support body 142 opposite to the two first limitation protrusions 108. The second support 16 includes two second surface limitation structures 172 disposed on the second support body 162 opposite to the two second limitation protrusions 110. Furthermore, the first limitation protrusion 108 and the second limitation protrusion 110 are located between the first surface limitation structure 152 and the second surface limitation structure 172, so the first surface limitation structure 152 and the second surface limitation structure 172 can structurally restrict the first limitation protrusion 108 and the second limitation protrusion 110 so as to control the horizontal position of the keycap 10 relative to the first support 14 and the second support 16.

In the embodiment, the first limitation protrusion 108 has a first convex surface 1082 toward the first surface limitation structure 152. The first surface limitation structure 152 is a corresponding convex surface, which is formed by a side wall of a first recess on the first support body 142. The first limitation protrusion 108 enters in the first recess during the keycap 10 moves upward and downward. A first gap d1 is possibly formed between the first surface limitation structure 152 and the first limitation protrusion 108 (i.e. the shortest distance between the first convex surface 1082 and the convex surface of the first surface limitation structure 152). The second limitation protrusion 110 has a second convex surface 1102 toward the second surface limitation structure 172. The second surface limitation structure 172 is a corresponding convex surface, which is formed by a side wall of a second recess on the second support body 142. The second limitation protrusion 110 enters the second recess. A second gap d2 is possibly formed between the second surface limitation structure 172 and the second limitation protrusion 110 (i.e. the shortest distance between the second convex surface 1102 and the convex surface of the second surface limitation structure 172). The presence of the duo-convex abutting structure between the first convex surface 1082 and the convex surface of the first surface limitation structure 152, and/or between the second convex surface 1102 and the convex surface of the second surface limitation structure 172, even with first/second gaps d1/d2 therebetween, may alternatively abuts each other while the keycap 10 moving upward/downward with lowest incline. In other words, each of the first surface limitation structure and the first limitation protrusion respectively comprises a convex surface proximately facing and alternatively abutting each other while the keycap moves upward and downward, and each of the second surface limitation structure and the second limitation protrusion comprises another convex surface proximately facing and alternatively abutting each other while the keycap moves upward and downward. For example, four pairs of such duo-convex abutting structures are included in a keyswitch 1, at one or two or more of these duo-convex abutting structures may provide smooth abutting effect during the entire upward/downward movements of the keycap 10. Therefore, the keycap 10 can be kept at a level status, relying on the duo-convex abutting structures to adjust and remain the smooth movements of the keycap 10. The presence of the gaps and the duo-convex abutting structure also helps to reduce or eliminate wear between the components during movement. In practice, it is practicable to maintain the sum of the first gap d1 and the second gap d2 substantially within a proper predetermined range by designing the structural relationships between the first limitation protrusion 108, the second limitation protrusion 110, the first surface limitation structure 152, and the second surface limitation structure 172 (e.g. by simulating the keycap 10 at different vertical positions, the relative locations of the components can determine the structural profiles of the limitation protrusions 108 and 110 and the surface limitation structures 152 and 172).

For actual different embodiments, by the different sizes of the components of the keyswitch structure 1, the sum of the first gap d1 and the second gap d2 can be set to different values or ranges as required, so that during the action of the keyswitch structure 1 (e.g. a user presses the keycap), a gap exists at least between the first limitation protrusion 108 and the first surface limitation structure 152 or between the second limitation protrusion 110 and the second surface limitation structure 172, which can make the movement of these components smooth, keep the keycap 10 level while moving upward/downward without incline and provide positioning effect to the keycap 10. For example, when the whole size of the first support 14, the second support 16, and the keycap 10 is relatively small or the lengths and widths of the first support 14 and the second support 16 relative to the keycap 10 are relatively small, the sum of the first gap d1 and the second gap d2 can be set to being within a range from 0.01 mm to 0.05 mm, from 0.05 mm to 0.15 mm, or from 0.15 mm to 0.25 mm. When the whole size of the first support 14, the second support 16, and the keycap 10 is relatively larger, or the lengths and widths of the first support 14 and the second support 16 relative to the keycap 10 are relatively large, the sum of the first gap d1 and the second gap d2 can be set in a range from 0.35 mm to 0.45 mm, from 0.45 mm to 0.55 mm, or from 0.55 mm to 0.65 mm. For another example, in an embodiment, the length and width of the keycap 10 are about 15 mm, the press stroke is 1 mm to 2 mm, and the sum of the first gap d1 and the second gap d2 can be set in a range from 0.25 mm to 0.35 mm.

Furthermore, in the embodiment, the first limitation protrusion 108 and the second limitation protrusion 110 are symmetric in structural logic. The first surface limitation structure 152 and the second surface limitation structure 170 are also symmetric in structural logic. However, it is not limited thereto in practice. For example, based on different actual component sizes and linkage relationships of the first support 14 and the second support 16, the movement tracks of the first support 14 and the second support 16 relative to the keycap 10 may be different, and the first convex surface 1082 and the second convex surface 1102 of the keycap 10 may need different profiles (and so do the corresponding first surface limitation structure 152 and the corresponding second surface limitation structure 172). Furthermore, in practice, the first limitation protrusion 108 and the second limitation protrusion 110 can be designed to protrude 0.65 mm to 0.75 mm from the bottom surface of the keycap 10. The first surface limitation structure 152 and the second surface limitation structure 172 can be designed as a ¼ cylinder surface with a radius of 0.5 mm. The first/second recesses on the first support 14 and the second support 16 (therein the first surface limitation structure 152 and the second surface limitation structure 172 are respectively disposed at one side thereof) can be designed to be 1 mm long, 1.6 mm wide, and 0.8 mm deep.

Figure 13:
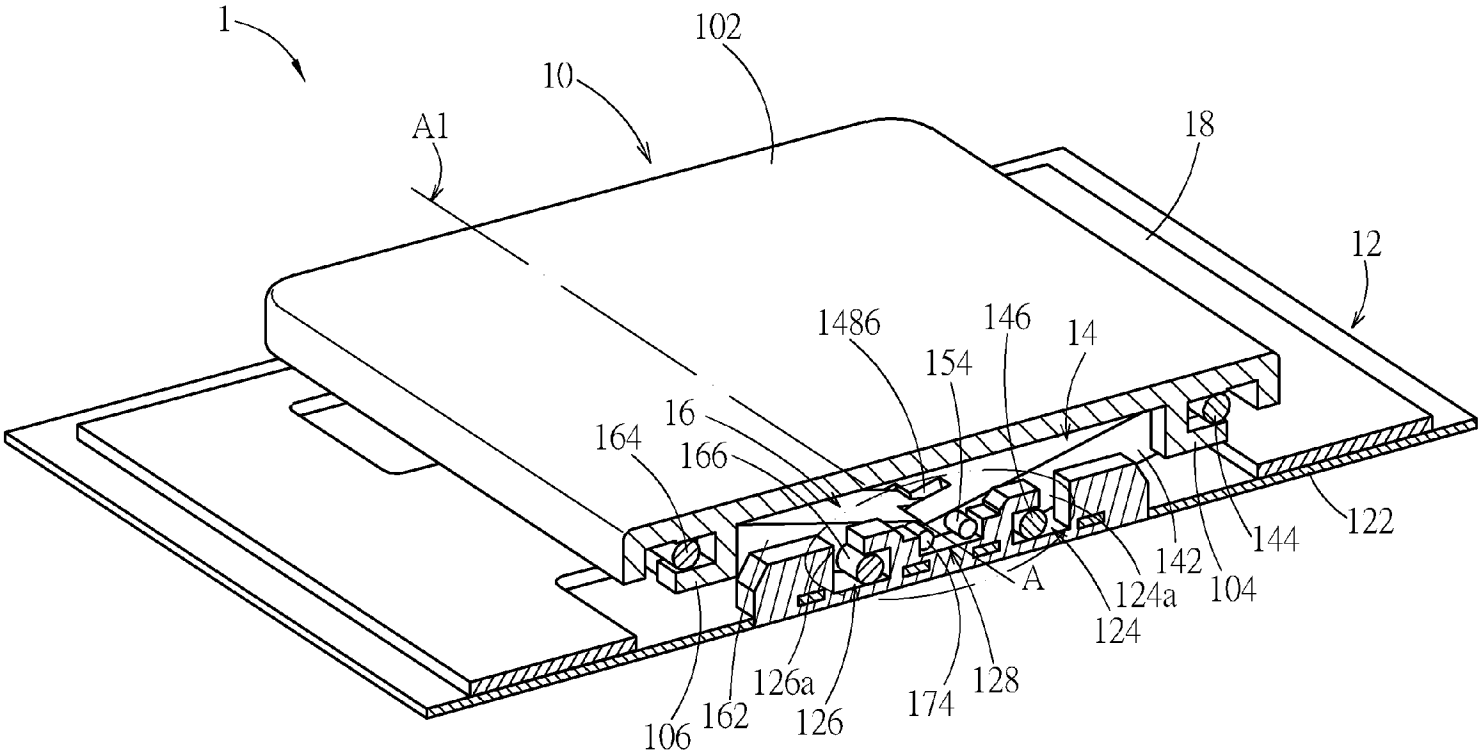
FIG. 13 is a perspective sectional view of the keyswitch structure in FIG. 1.
Figure 14:
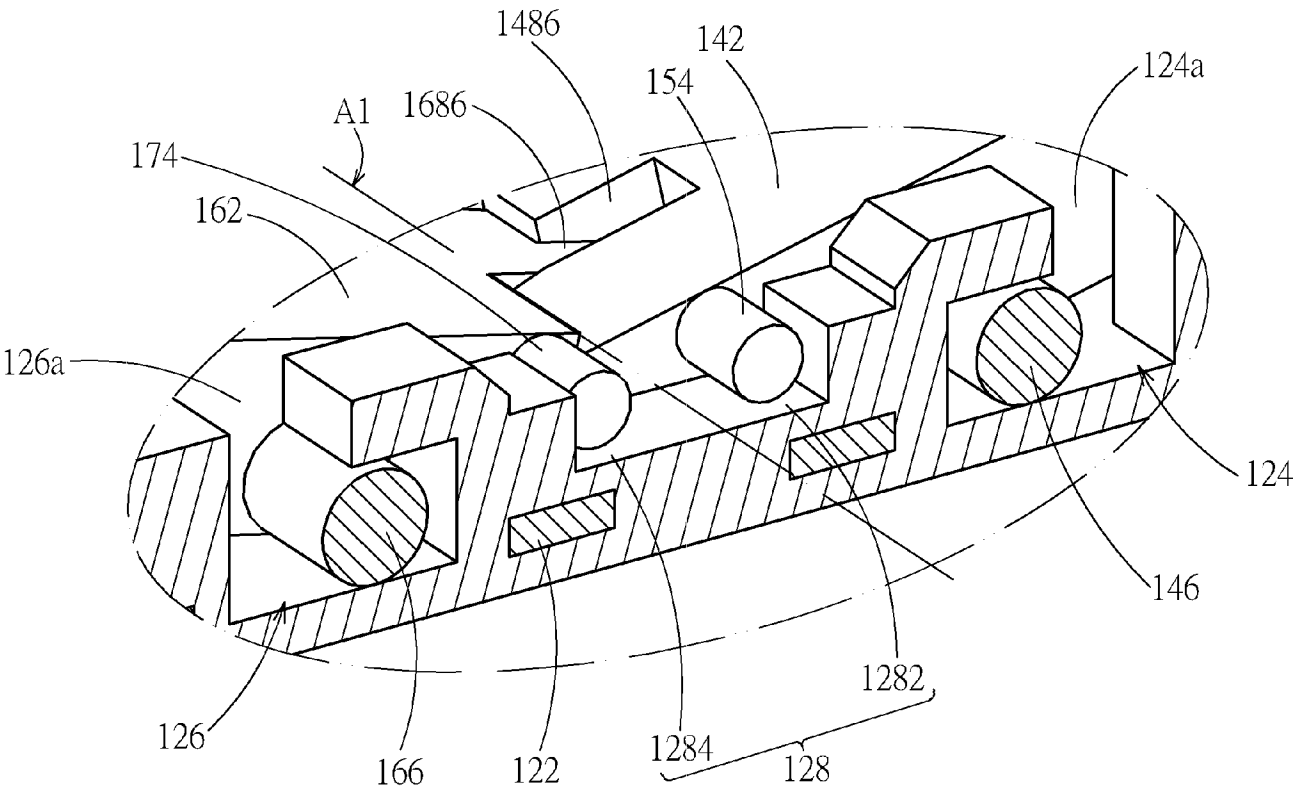
FIG. 14 is an enlarged view of the circle A in FIG. 13.

Please refer to FIG. 2, FIG. 3, FIG. 13 and FIG. 14. In the embodiment, the keyswitch structure 1 further includes two abutting structures which include two first posts 154 disposed at two sides of the first support 14 and two second posts 174 disposed at two sides of the second support 16. Therein, one abutting structure includes one first post 154 and one second post 174. The first post 154 and the second post 174 extend parallel to the rotation axis A1 and are not limited to be integrally formed into the first support 14 and the second support 16 to be one piece respectively. The base 12 includes two limitation portions 128 disposed opposite to the two abutting structures (i.e. disposed opposite to the first posts 152 and the second posts 172). Therein, one limitation portion 128 corresponds to one first post 152 and one second post 172. In the embodiment, the limitation portions 128 is realized by a recess structure and is integrally formed into a plastic part that includes the first sliding slot 124 and the second sliding slot 126. The limitation portion 128 includes a first limitation surface 1282 and a second limitation surface 1284. When the keycap 10 is not pressed, the first post 154 and the second post 174 abut against the first limitation surface 1282 and the second limitation surface 1284 of the limitation portion 128 respectively, as shown by FIG. 13 and FIG. 14. When the keycap 10 is pressed, the first post 154 and the second post 174 are separate from the first limitation surface 1282 and the second limitation surface 1284 respectively. Thereby, the highest position of the keycap 10 can be limited, which is conducive to the action stability of the keyswitch structure 1 and is also conducive to the tactile feedback to users.

Figure 15:
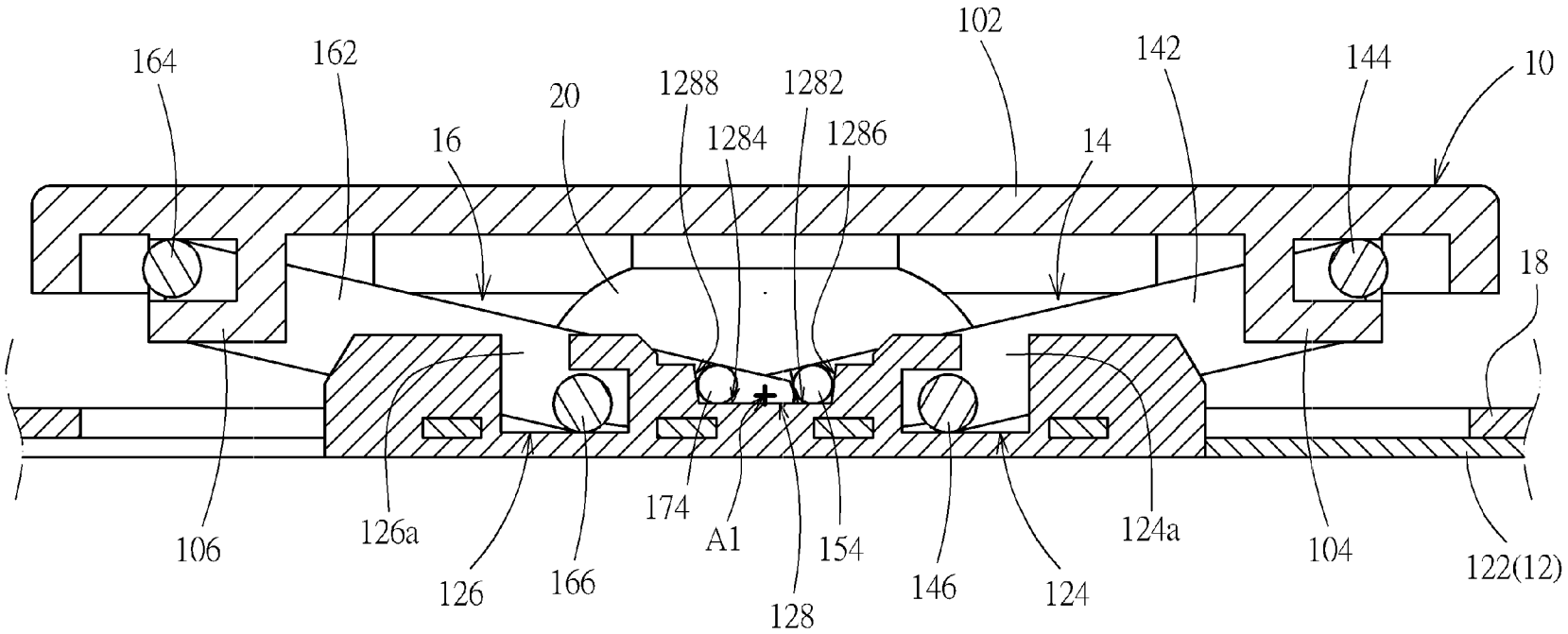
FIG. 15 is a sectional view of a keyswitch structure according to an embodiment.
Figure 16:
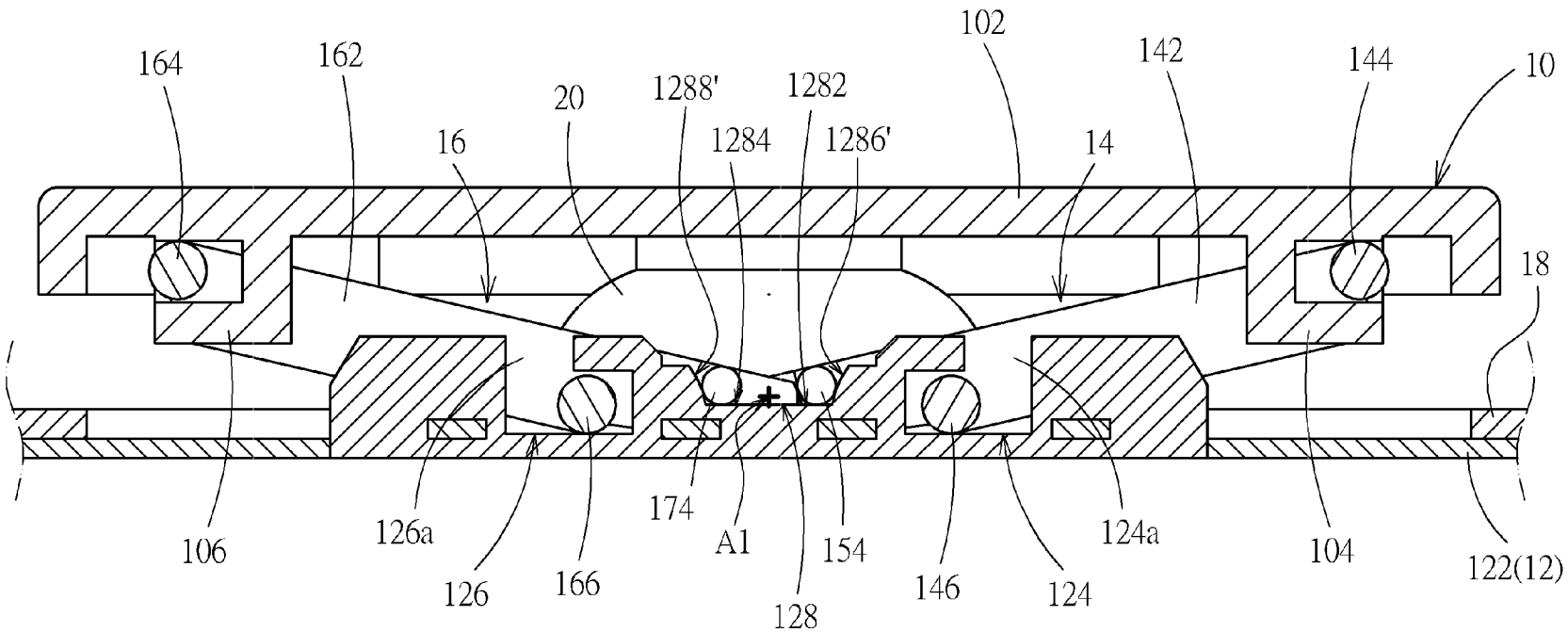
FIG. 16 is a sectional view of a keyswitch structure according to an embodiment.

Furthermore, in the embodiment, the limitation portion 128 is realized by the bottom surface of the recess structure. However, it is practicable to realize the limitation portion 128 by the side surfaces of the recess structure in practice. In coordination with the slidably connection relationship between the first and second base connection portions 146 and 166 and the base 12, the profiles of the side surfaces can be used for limiting, restricting the slides of the first base connection portion 146 and the second base connection portion 166 in the first sliding slot 124 and the second sliding slot 126 respectively (e.g. when the keycap 10 moves up and down relative to the base 12, the variation in horizontal position of the first support 14 and the second support 16 relative to the base 12 can be controlled), which is conducive to the action stability of the first support 14 and the second support 16 relative to the base 12 and is also conducive to the action stability of the keyswitch structure 1. For example, as shown by FIG. 15, the limitation portion 128 includes a first guiding side surface 1286 and a second guiding side surface 1288 that are disposed opposite to each other and adjoin the first limitation surface 1282 and the second limitation surface 1284 respectively. The first post 154 and the second post 174 are located between the first guiding side surface 1286 and the second guiding side surface 1288. The first guiding side surface 1286 and the second guiding side surface 1288 are slanted surfaces. When the keycap 10 moves relative to the base 12, the first post 154 and the second post 174 substantially keep in abutting against the first guiding side surface 1286 and the second guiding side surface 1288 respectively. For another example, as shown by FIG. 16, the limitation portion 128 includes a first guiding side surface 1286' and a second guiding side surface 1288' that are disposed opposite to each other and adjoin the first limitation surface 1282 and the second limitation surface 1284 respectively. The first post 154 and the second post 174 are located between the first guiding side surface 1286' and the second guiding side surface 1288'. The first guiding side surface 1286' and the second guiding side surface 1288' are curved surfaces. When the keycap 10 moves relative to the base 12, the first post 154 and the second post 174 substantially keep in abutting against the first guiding side surface 1286' and the second guiding side surface 1288'. Furthermore, in practice, the first guiding side surface and the second guiding side surface are not limited to have the same structure; for example, one is a slanted surface and the other is a curved surface.

Figure 17:
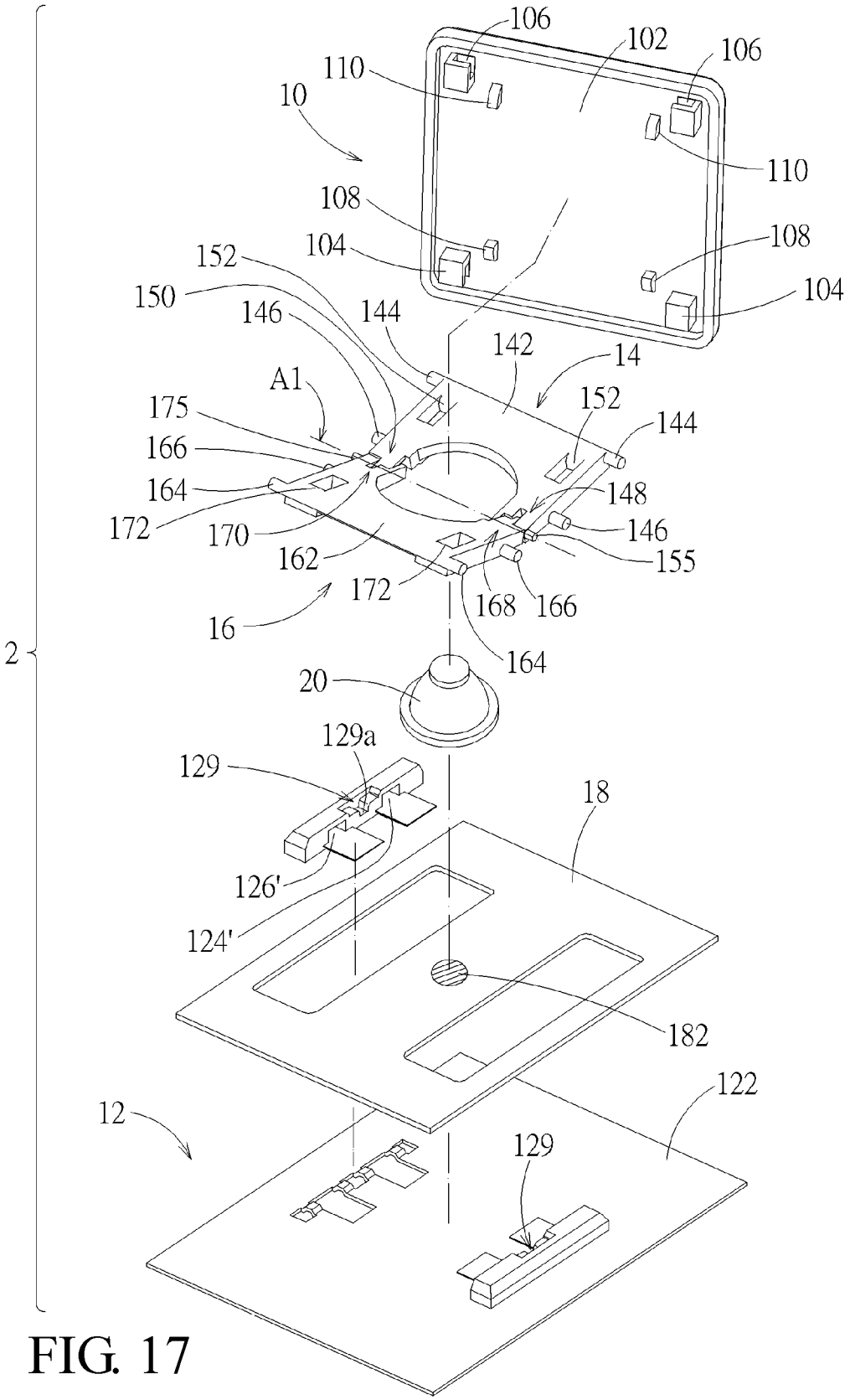
FIG. 17 is a partially exploded view of the keyswitch structure according to another embodiment.
Figure 18:
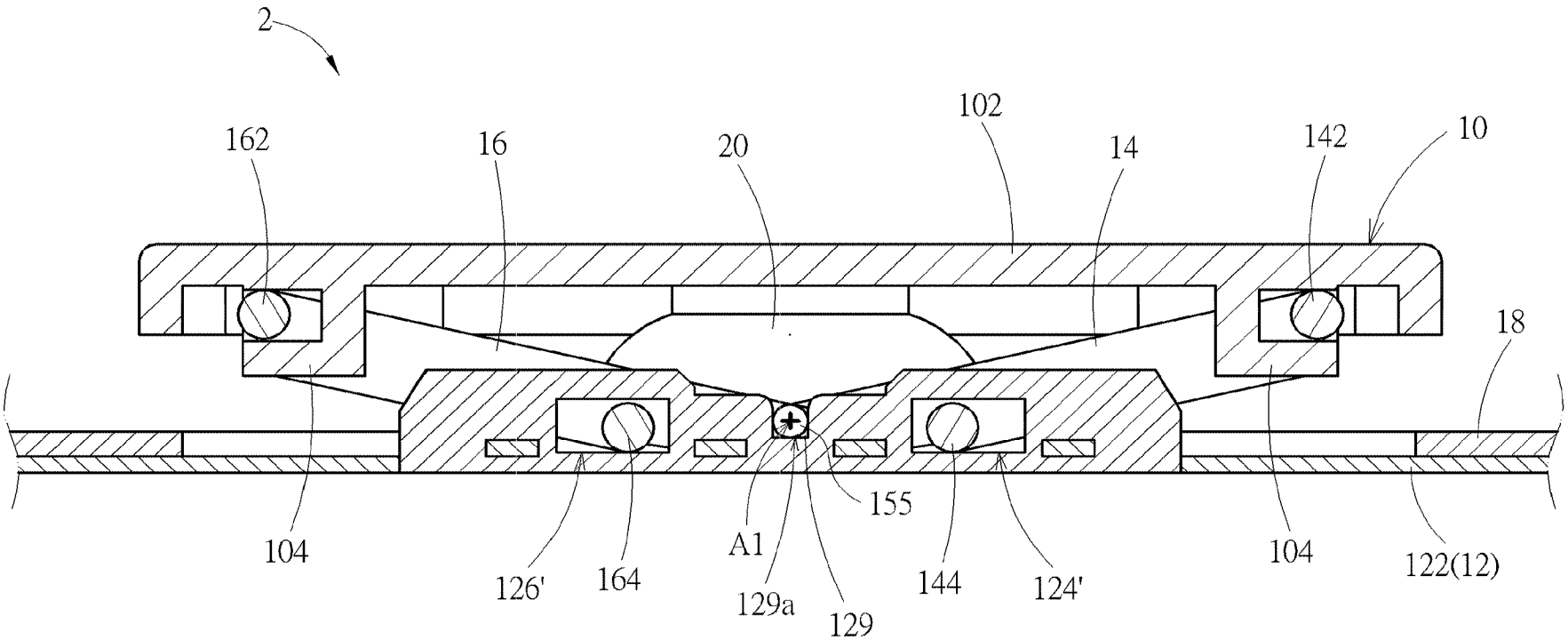
FIG. 18 is a sectional view of the keyswitch structure in FIG. 17.

Furthermore, within the keyswitch structure 1, each of the limitation portions 128 is corresponding paired with one first post 154 and one second post 174. However in the practical embodiments, a single limitation portion 128 may also be paired with either one first post 154 or one second post 174, which can still achieve the effects for the limitation portion to structurally restrict and restrain the abutting structure, thereby limiting the height of the keycap 10 through the interactions between the first support 14 and the second support 16. For instance, a keyswitch structure 2 shown in FIG. 17 and FIG. 18 is similar to the structure of keyswitch structure 1, so the element symbols and numbers mainly follow those introduced in the keyswitch structure 1. Regarding the basic introduction of the keyswitch structure 2 and the derivative embodiments, please refer to the keyswitch structure 1 and its and derivatives. Comparing to keyswitch structure 1, the limitation portion in the keyswitch structure 2 is realized as two guiding slots 129, which vertically extends and correspondingly configured at two sides of each of the first support 14 and second support 16. The abutting structure of the keyswitch structure 2 is realized by two central posts 155, 175, each of which is configured on the first support 14 (or the first shaft side wall 1488 of the first pivotal connection portion 148) and the second support 16 (or the second shaft side wall 1708 of the fourth pivotal connection portion 170) respectively and extends along the rotation axis A1. The central posts 155, 175 are respectively slidably configured in the guiding slot 129; namely, one guiding slot 129 is paired with one post (the central posts 155 or the post 175). When the keycap 10 is not pressed, each of the central posts 155, 175 abuts a closed end **129*a* of the corresponding guiding slot 129. When the keycap 10 moves relatively to the base 12, each of the central posts 155, 175 substantially remains two opposite sidewalls of the corresponding guiding slot 129. Besides, in this embodiment, the first sliding slot 124' and second sliding slot 126' of the keyswitch structure 2 are both closed structures (namely without the first inlet 124*a* and second inlet 126*a*), this is helpful for the first base connection portion 146 and the second base connection portion 166 to stably slide within the first sliding slot 124' and the second sliding slot 126'**.

Figure 19:
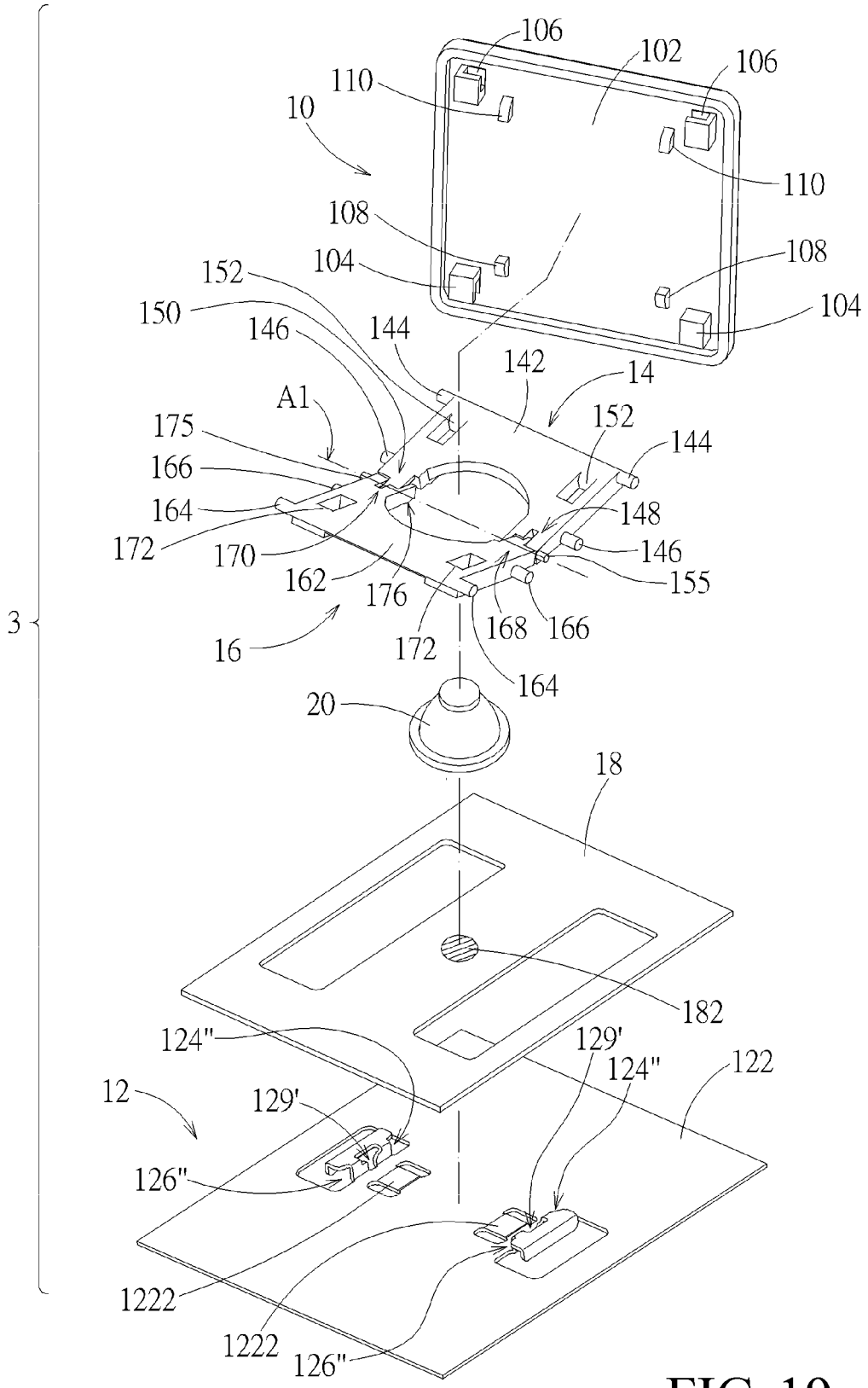
FIG. 19 is a partially exploded view of the keyswitch structure according to another embodiment.
Figure 20:
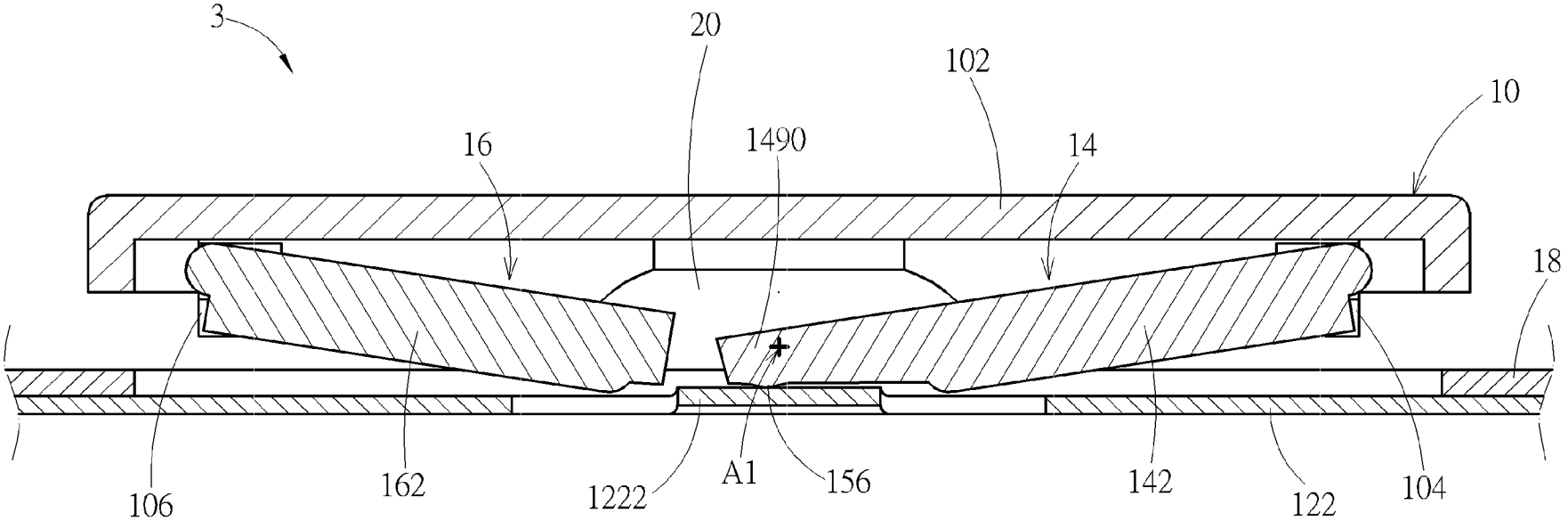
FIG. 20 is a sectional view of the keyswitch structure in FIG. 19.

Moreover, a keyswitch structure 3, in another embodiment as shown FIG. 19 and FIG. 20, has structures similar to the above-mentioned keyswitch structures 1, 2, so the element symbols and numbers mainly follow those introduced in the keyswitch structures 1, 2. Regarding the basic introduction of the keyswitch structure 3 and the derivative embodiments, please refer to the keyswitch structures 1, 2 and its and derivatives. Comparing to the keyswitch structures 1, 2, a guiding slot 129' of the keyswitch structure 3 is formed by bending a portion of the base plate 122, and a first sliding slot 124" and second sliding slot 126" of the keyswitch structure 3 are also formed by bending portions of the base plate 122. In other words, the base plate 122 and guiding slot 129' (or the limitation portion), the first sliding slot 124" and second sliding slot 126" are formed integrally on the base plate 22, which contributes to lower the manufacturing costs. Such design may also be implemented in the keyswitch structure 1, the details will not be further described repeatedly.

In addition, in this embodiments, the limitation portion of the keyswitch structure 3 further includes two raised portions 1222 for each of the first and second supports 14, 16. The two raised portions 1222 are structures upwardly protruded from the base plate 122 (for example: the raised portion 1222 is formed by punching-press procedure of a metal base plate 122, so that such raised portion 1222 has a certain level of elasticity). The abutting structure of the keyswitch structure 3 further comprises two protruding structures 156, 176, each of which are configured at end portions of the first support 14 and second support 16 and are protruding towards the base plate 122. For example, the protruding structures 156, 176 may be respectively formed integrally on each of the first support 14 and second support 16. When the keycap 10 is not pressed, the protruding structures 156, 176 abuts top surfaces of the raised portions 1222. Therefore, the raised portions 1222 (paired with the corresponding protruding structures 156, 176) and the guiding slot 129' (paired with the corresponding central posts 155, 175) all have the effect of limiting the highest position of the keycap 10. In actual implementations, for the limitation of the highest position of the keycap 10, the aforesaid embodiments regarding the limitation portion (s) and abutting structure (s), may be selectively realized by any of which. Additionally, in this embodiments, the first support 14 and second support 16 are connected to form a circled structure (or a closed rectangular ring structure), with the raised portion 1222 configured at the inner side of the circled structure.

Figure 21:
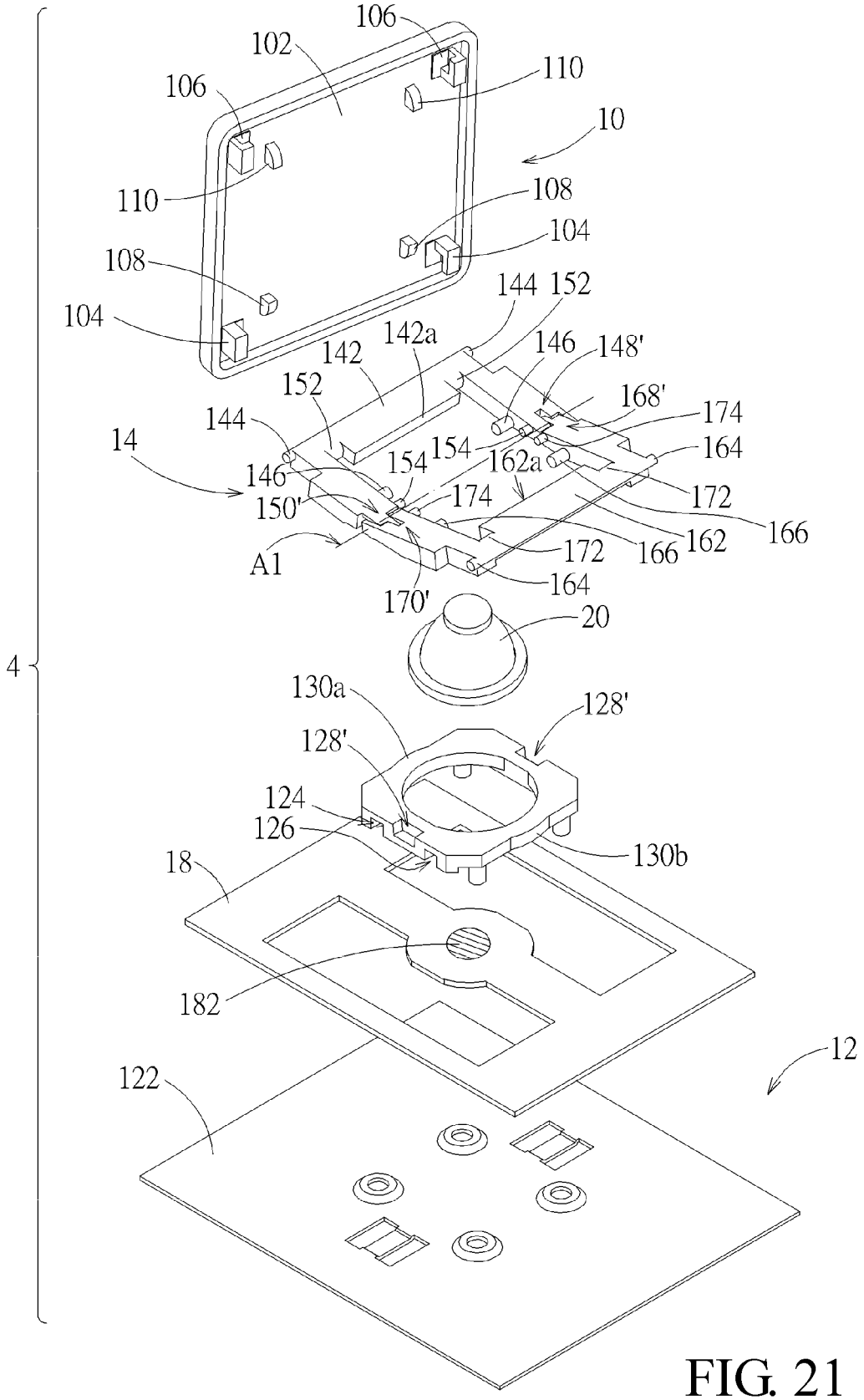
FIG. 21 is a partially exploded view of the keyswitch structure according to another embodiment.
Figure 22:
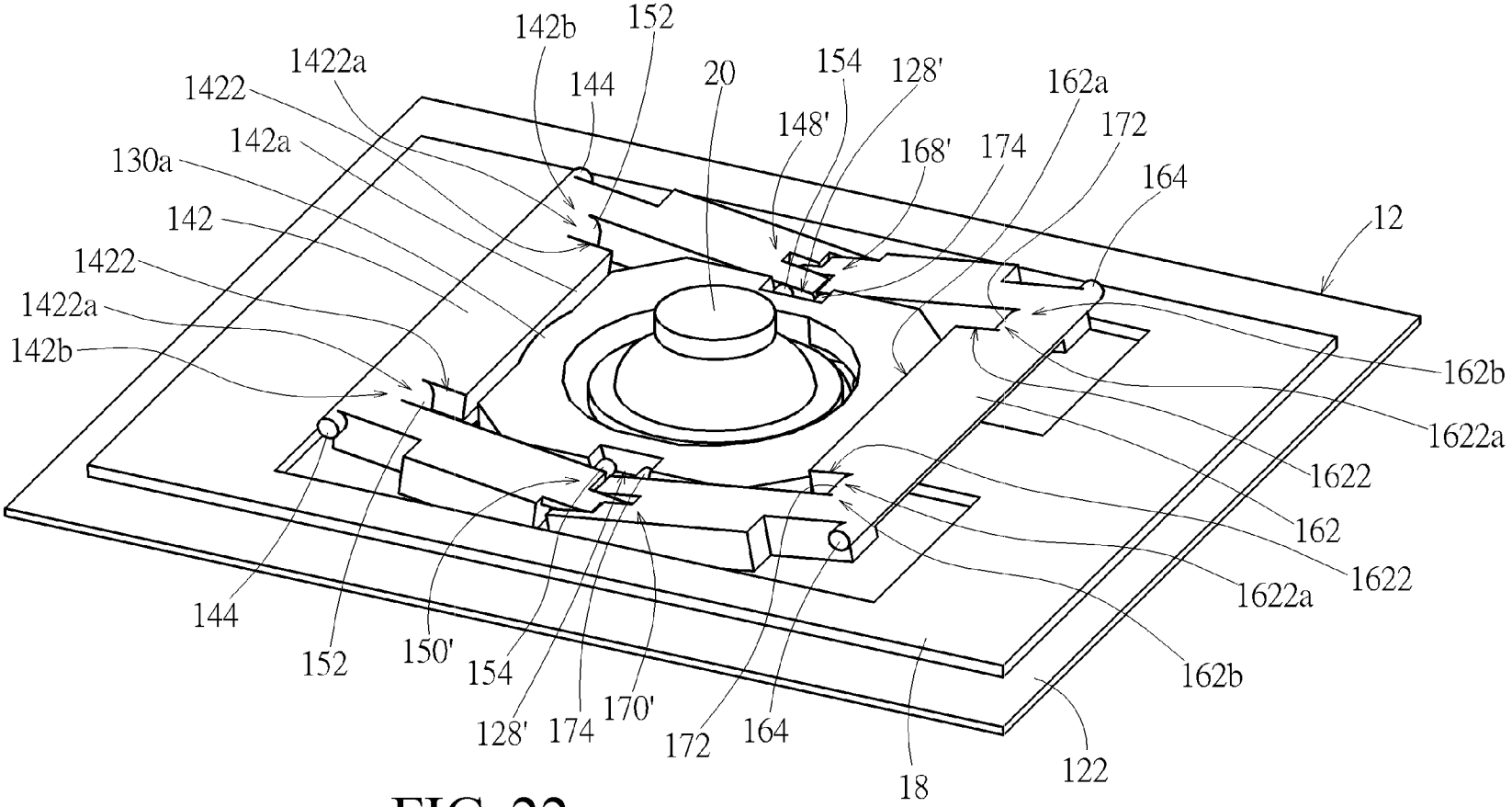
FIG. 22 is a perspective view of the keyswitch structure in FIG. 21 with the keycap being removed.
Figure 23:
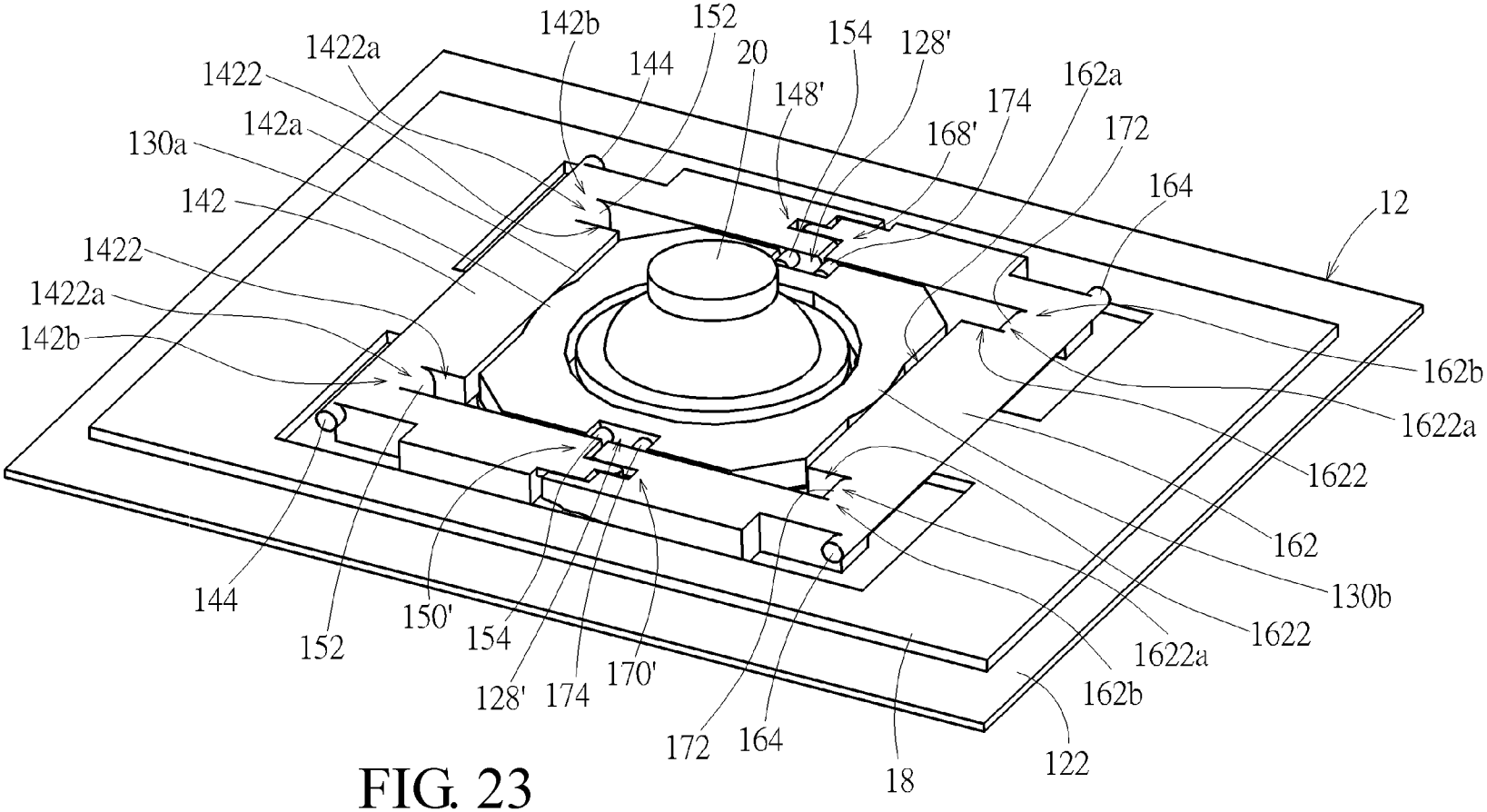
FIG. 23 is a perspective view of the keyswitch structure in FIG. 22 when the keycap is pressed down.

Besides, in another embodiment, a keyswitch structure 4, as shown in FIG. 21, FIG. 22 to FIG. 23, are structurally similar to the keyswitch structure 1, so the element symbols and numbers mainly follow those introduced in the keyswitch structure 1. Regarding the basic introduction of the keyswitch structure 4 and the derivative embodiments, please refer to the keyswitch structure 1 and its and derivatives. Comparing to the keyswitch structure 1, the first support 14 and second support 16 of the keyswitch structure 4 connects with the base 12 by abutting the base plate 122. The base 12 of the keyswitch structure 4 comprises an annulus member 130. Here the annulus member 130 is fastened onto the base plate 122 (through hot-melting riveting or insert molding), and fastened at the inner sides of the circled structure formed by the connected first support 14 and the second support 16. This annulus member 130 defines a limitation portion 128', and forms first sliding slot 125 and second sliding slot 127 jointly with the base plate 122. The first post 154 and second post 174 are also formed on the inner sides of the circled structure (namely extended inwardly from the first support body 142 and the second support body 162 in parallel to the rotation axis A1), thereby achieving the effects for the limitation portion 128 to restrict and restrain the first post 154 and second post 174. The first base connection portion 146 of the first support 14 and the second base connection portion 166 of the second support 16 are also configured on the inner sides of the circled structure (namely extended inwardly from the first support body 142 and the second support body 162 in parallel with the rotation axis A1). Each of the first base connection portion 146 and the second base connection portion 166 are slidably configured within the first sliding slot 125 and second sliding slot 127 respectively. Such structural design helps to shrink the size of the keyswitch structure 4 along the direction of the rotation axis A1.

In addition, in this embodiment, the annulus member 130 includes two opposite limitation protrusions 130*a*, 130*b* along a direction vertical to the rotation axis A1, each of which respectively faces to and aligns with one of a first support inner surface 142*a* of the first support body 142 and a second support inner surface 162*a* of the second support body 162. The structural restriction effects applied by the limitation protrusions 130*a*, 130*b* to the first support inner surface 142*a* and second support inner surface 162*a*, help the first support 14 and second support 16 to rotate stably and relatively to the base 12. Furthermore, in this embodiments, the U-shaped structure of the first support 14 has two open slots 1422, defined at two inner corners 142*b* of the U-shaped structure of the first support 14. The first surface limitation structure 152 of the first support 14 is formed at a closed endface 1422*a* of at least one of the open slots 1422. The meanwhile, the U-shaped structure of second support 16 also has two similar open slots 1622, defined at two inner corners 162*b* of the U-shaped structure of second support 16. The second surface limitation structure 172 of the second support 16 is formed at a closed endface 1622*a* of at least one of the open slots 1622. Besides, in this embodiment, the first pivotal connection portion 148', the second pivotal connection portion 168', the third pivotal connection portion 150' and the four pivotal connection portion 170' are slightly different with the structures of the first pivotal connection portion 148, the second pivotal connection portion 168, the third pivotal connection portion 150 and the four pivotal connection portion 170 within the keyswitch structure 1, yet each of these pivotal connection portions has connecting architectures similar to each other. Therefore, the connecting structures between the first pivotal connection portion 148' and the second pivotal connection portion 168', and between the third pivotal connection portion 150' and the four pivotal connection portion 170' may be clearly understand based on the aforesaid descriptions related to the connecting structures between the first pivotal connection portion 148 and the second pivotal connection portion 168, and between the third pivotal connection portion 150 and the four pivotal connection portion 170 in the above embodiments.

Moreover, in each of the aforesaid embodiments, the connection type (s) for the first support 14 and second support 16 to connect with the keycap 10 and the base 12 (such as rotatable connection and/or slidable connection) may be determined by actual implementations.

Those skilled in the art will readily observe that numerous modifications and alterations of the device method may be made while retaining the teachings of the invention. Accordingly, the above disclosure should be construed as limited only by the metes and bounds of the appended claims.

What is claimed is:

1. A keyswitch structure, comprising:

a keycap;

a base, disposed under the keycap and comprising a limitation portion;

a first support, connected to and between the keycap and the base;

a second support, connected to and between the keycap and the base, the first support and the second support being pivotally connected, the keycap being up and down movable relative to the base through the first support and the second support; and an abutting structure, disposed on the first support or the second support opposite to the limitation portion, wherein when the keycap is not pressed, the abutting structure abuts against the limitation portion, wherein the keycap comprises a first limitation protrusion and a second limitation protrusion, the first support comprises a first surface limitation structure with the first surface limitation structure being disposed corresponding to the first limitation protrusion, wherein the second support comprises a second surface limitation structure with the second surface limitation structure being disposed correspondingly to the second limitation protrusion, and wherein each of the first surface limitation structure and the first limitation protrusion respectively comprises a convex surface proximately facing and alternatively abutting each other while the keycap moves upward and downward, and each of the second surface limitation structure and the second limitation protrusion comprises another convex surface proximately facing and alternatively abutting each other while the keycap moves upward and downward.

2. The keyswitch structure according to claim 1, wherein the first support and the second support pivotally connects with each other relative to a rotation axis, the abutting structure is a central post extending along the rotation axis.

3. The keyswitch structure according to claim 1, wherein the limitation portion is a guiding slot extended vertically, and the central post is slidably configured in the guiding slot, and the central post abuts a closed endface of the guiding slot when the keycap is not pressed.

4. The keyswitch structure according to claim 3, wherein the base comprises a base plate, and a portion of the base plate is bended upwardly to form the guiding slot.

5. The keyswitch structure according to claim 1, wherein the base comprises a base plate, and a portion of the base plate is bended upwardly to form the limitation portion.

6. The keyswitch structure according to claim 5, wherein the bended portion of the base plate forms a first sliding slot and a second sliding slot, the first support slidably connecting to the base through the first sliding slot, and the second support connecting to the base through the second sliding slot.

7. The keyswitch structure according to claim 1, wherein the base comprises a base plate, the base plate having a raised portion to form the limitation portion, the abutting structure abutting a top surface of the raised portion when the keycap is not pressed.

8. The keyswitch structure according to claim 1, wherein the first support and the second support are connected to form a circled structure, and the limitation portion is located at an inner side of the circled structure.

9. The keyswitch structure according to claim 8, wherein the base comprising a base plate and an annulus member fastened onto the base plate, the annulus member is fastened at an inner side of the circled structure to form the limitation portion.

10. The keyswitch structure according to claim 1, wherein the first support and the second support pivotally connects with each other relative to a rotation axis, and the abutting structure comprises a first post and a second post both extending in parallel to the rotation axis and correspondingly configured on the first support and the second support respectively.

11. The keyswitch structure according to claim 10, wherein the limitation portion comprises a first limitation surface and a second limitation surface, the first post and the second post correspondingly abuts the first limitation surface and the second limitation surface when the keycap is not pressed, the first post and the second post and the first limitation surface and the second limitation surface separate when the keycap is pressed.

12. The keyswitch structure according to claim 10, wherein the limitation portion comprises a first guiding side surface and a second guiding side surface, the first post and the second post is disposed between the first guiding side surface and the second guiding side surface, the first guiding side surface or the second guiding side surface is a slanted surface or a curved surface, when the keycap moves relatively to the base, the first post and the second post correspondingly abut the first guiding side surface and the second guiding side surface.

13. The keyswitch structure according to claim 1, wherein the first surface limitation structure and the first limitation protrusion has a first gap therebetween, while the second surface limitation structure and the second limitation protrusion has a second gap, a sum of the first gap and the second gap being substantially within a predetermined range.

14. The keyswitch structure according to claim 13, wherein the first support forms a U-shaped structure and has an open slot at a corner of the U-shaped structure, and the first surface limitation structure is formed at a closed endface of the open slot.

15. A keyswitch structure, comprising:

a keycap, comprising a first limitation protrusion and a second limitation protrusion;

a base, disposed under the keycap;

a first support, connected to and between the keycap and the base and comprising a first surface limitation structure disposed opposite to the first limitation protrusion; and a second support, connected to and between the keycap and the base, the first support and the second support being pivotally connected, the keycap being up and down movable relative to the base through the first support and the second support, and the second support comprising a second surface limitation structure disposed opposite to the second limitation protrusion;

wherein each of the first surface limitation structure and the first limitation protrusion respectively comprises a convex surface proximately facing and alternatively abutting each other while the keycap moves upward and downward, and each of the second surface limitation structure and the second limitation protrusion comprises another convex surface proximately facing and alternatively abutting each other while the keycap moves upward and downward.

16. The keyswitch structure according to claim 15, wherein a first gap is formed between the first surface limitation structure and the first limitation protrusion, and a second gap is formed between the second surface limitation structure and the second limitation protrusion, a sum of the first gap and the second gap being substantially within a predetermined range.

17. The keyswitch structure according to claim 15, wherein the first surface limitation structure is formed on a sidewall of a first recess on the first support, and first limitation protrusion enters in the first recess during the keycap moving upward and downward.

18. The keyswitch structure according to claim 15, wherein the first support forms a U-shaped structure and has an open slot at a corner of the U-shaped structure, and the first surface limitation structure is formed at a closed end-face of the open slot.

19. The keyswitch structure according to claim 15, wherein the first support and the second support are connected to form a circled structure.

20. The keyswitch structure according to claim 19, wherein the base comprising a base plate and an annulus member fastened onto the base plate, the annulus member is fastened at an inner side of the circled structure.

* * * * *